US008170460B2

(12) United States Patent
Matsushima

(10) Patent No.: US 8,170,460 B2
(45) Date of Patent: May 1, 2012

(54) IMAGE FORMING APPARATUS, IMAGE FORMING METHOD, AND PRINTING MEDIUM

(75) Inventor: Yuki Matsushima, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 460 days.

(21) Appl. No.: 12/466,579

(22) Filed: May 15, 2009

(65) Prior Publication Data

US 2009/0285612 A1 Nov. 19, 2009

(30) Foreign Application Priority Data

May 16, 2008 (JP) ..... 2008-129831

(51) Int. Cl.
*G03G 15/20* (2006.01)
*G03G 13/01* (2006.01)

(52) U.S. Cl. ..... 399/342; 399/122; 399/265; 399/341; 399/407; 399/409; 430/45.1; 156/277

(58) Field of Classification Search ..... 399/122, 399/265, 320, 342, 407, 409; 430/45.1; 156/277
See application file for complete search history.

(56) References Cited

U.S. PATENT DOCUMENTS

| | | | | |
|---|---|---|---|---|
| 6,042,985 | A * | 3/2000 | Matsuda et al. | 430/125.6 |
| 7,236,734 | B2 * | 6/2007 | Ng et al. | 399/341 |
| 7,260,354 | B2 * | 8/2007 | Ishida | 399/409 |
| 7,313,354 | B2 * | 12/2007 | Tsuda et al. | 399/341 |
| 7,340,208 | B2 * | 3/2008 | Ng | 399/329 |
| 7,510,275 | B2 | 3/2009 | Matsushima | |
| 7,783,242 | B2 * | 8/2010 | Chigono et al. | 399/341 |
| 7,787,815 | B2 * | 8/2010 | Nakamura et al. | 399/341 |
| 7,995,959 | B2 * | 8/2011 | Nakamura et al. | 399/341 |
| 8,023,877 | B2 * | 9/2011 | Sudo et al. | 399/341 |
| 2006/0133871 | A1 * | 6/2006 | Ishida | 399/341 |
| 2008/0080913 | A1 * | 4/2008 | Van Bortel et al. | 399/341 |
| 2008/0236736 | A1 * | 10/2008 | Nakamura et al. | 156/277 |

FOREIGN PATENT DOCUMENTS

| | | | |
|---|---|---|---|
| JP | 05249724 | A * | 9/1993 |
| JP | 7-72695 | | 3/1995 |
| JP | 2003098717 | A * | 4/2003 |
| JP | 2004112548 | A * | 4/2004 |
| JP | 2006103216 | A * | 4/2006 |
| JP | 2006-220985 | | 8/2006 |
| JP | 2007258835 | A * | 10/2007 |
| JP | 2008-229906 | | 10/2008 |

* cited by examiner

*Primary Examiner* — David Gray
*Assistant Examiner* — Francis Gray
(74) *Attorney, Agent, or Firm* — Cooper & Dunham LLP

(57) ABSTRACT

An image forming apparatus includes an image forming device, an adhesion processing device, an adhesion device, and a fixing device. The image forming device forms an image on a light-transmitting medium with image formation toner. The adhesion processing device sets whether or not to make the light-transmitting medium contact a light-reflecting medium for each of multiple areas of the image. The adhesion device adheres adhesive toner to an area of the light-transmitting medium. The fixing device aligns the light-reflecting medium with the light-transmitting medium such that the light-reflecting medium contacts a surface of the light-transmitting medium to which the adhesive toner adheres and fixes the light-reflecting medium to the light-transmitting medium.

18 Claims, 20 Drawing Sheets

REFLECTION SAMPLE A

REFLECTION SAMPLE B

IMAGE FORMING APPARATUS, IMAGE FORMING METHOD, AND PRINTING MEDIUM

BACKGROUND

1. Technical Field

The present specification describes an image forming apparatus, an image forming method, and a printing medium, and more particularly, an image forming apparatus, an image forming method, and a printing medium capable of forming a glossy image with high color saturation.

2. Discussion of the Background

Compared to text and line images, photo images typically need to be superior in quality of gradation, graininess, color reproduction, and the like. Therefore, such photo images need to have a mirror-smooth glossy surface or a matte finished surface.

In order to create a glossy photo image, one related-art electrophotographic image forming apparatus forms an image on a light-transmitting medium and attaches a backing layer on an image carrying surface of the light-transmitting base. Another related-art image forming apparatus forms a coloring agent layer on one of a light-transmitting medium and a light-reflecting medium, attaches an adhesive material to the whole surface of the other one of the light-transmitting medium and the light-reflecting medium, and fixes them together.

However, in addition to a glossy finish, such photo images formed by electrophotographic image forming apparatuses need to have a broad color reproduction area, that is, a broad gamut. However, the pigment used as a coloring agent in electrophotography is less transparent than the dye used in ink-jet printers. In particular, reproduction of a mixed color with high saturation is difficult. Inkjet printers can easily increase the number of color inks in order to broaden the color gamut while controlling a total amount of ink. However, electrophotographic image forming apparatuses need to increase the number of photoconductors in order to increase the number of color inks, thereby complicating the image forming apparatus structure and degrading the performance thereof.

Accordingly, there is a need for a technology to provide an image forming apparatus capable of forming a high-quality color image with a high degree of saturation.

BRIEF SUMMARY

This patent specification describes an image forming apparatus, one example of which includes an image forming device, an adhesion processing device, an adhesion device, and a fixing device. The image forming device is configured to form an image on a light-transmitting medium with image formation toner. The adhesion processing device is configured to set whether or not to make the light-transmitting medium contact a light-reflecting medium for each area of a plurality of areas that constitute the image. The adhesion device is configured to adhere adhesive toner to an area of the light-transmitting medium. The fixing device is configured to align the light-reflecting medium with the light-transmitting medium such that the light-reflecting medium contacts a surface of the light-transmitting medium to which the adhesive toner adheres and to fix the light-reflecting medium to the light-transmitting medium.

This patent specification further describes an image forming method, one example of which includes forming an image on a light-transmitting medium with image formation toner, setting whether or not to make the light-transmitting medium contact a light-reflecting medium for each area of a plurality of areas that constitute the image, adhering adhesive toner to an area of the light-transmitting medium, aligning the light-reflecting medium with the light-reflecting medium such that the light-reflecting medium contacts a surface of the light-transmitting medium to which the adhesive toner adheres, and fixing the light-reflecting medium to the light-transmitting medium.

This patent specification further describes a printing medium manufactured by an image forming method including forming an image on a light-transmitting medium with image formation toner, setting whether or not to make the light-transmitting medium contact a light-reflecting medium for each area of a plurality of areas that constitute the image, adhering adhesive toner to an area of the light-transmitting medium, aligning the light-reflecting medium with the light-reflecting medium such that the light-reflecting medium contacts a surface of the light-transmitting medium to which the adhesive toner adheres, and fixing the light-reflecting medium to the light-transmitting medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF ILLUSTRATIVE EMBODIMENTS

Figure 1:
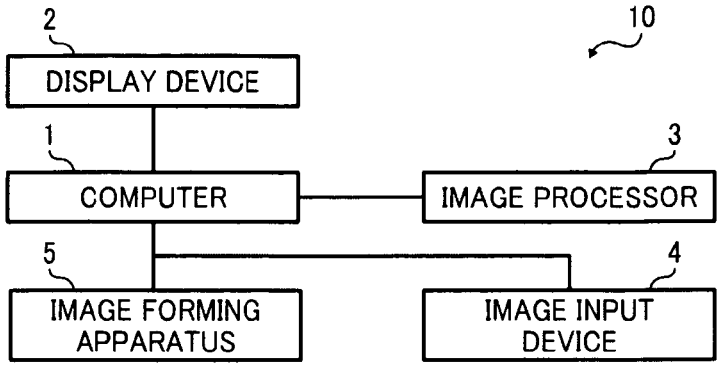
FIG. 1 is a schematic diagram of an image forming system according to an illustrative embodiment of the present disclosure.

In describing examples and embodiments illustrated in the drawings, specific terminology is employed for the sake of clarity. However, this disclosure is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming system 10 according to one illustrative embodiment is explained.

FIG. 1 is a schematic diagram of the image forming system 10. The image forming system 10 includes a computer 1, a display device 2, an image processor 3, an image input device 4, and an image forming apparatus 5.

The display device 2 and the image processor 3 are connected to the computer 1. The image input device 4 and the image forming apparatus 5 are connected to the computer 1 via a LAN (local area network) or the like. The computer 1 is loaded with software including various types of application software used for various types of information processing and image processing, print drivers, and the like. The display device 2 displays various output results. The image processor 3 converts color signals of RGB (red-green-blue), CMY (cyan-magnet-yellow), CMYK (cyan-magenta-yellow-black), or the like, unique to each device and supplied from the computer 1, into color signals unique to the image forming apparatus 5. The image processor 3 includes an adhesion processor, described later, for setting an area of a light-transmitting medium to which adhesive toner adheres.

The image input device 4 is an input device for retrieving image data, and for example, is a color scanner, a digital camera, or the like. The image forming apparatus 5 includes an image forming device, an adhesion device, and a fixing device, described later. The image forming device forms a color image on a light-transmitting medium such as an OHP (overhead projector) film, a transparency film, or the like based on image data (tone data). The adhesion device adheres adhesive toner to the light-transmitting medium. The fixing device fixes a light-reflecting medium such as a paper or the like to the light-transmitting medium. The image forming apparatus 5 may be, but is not limited to, any suitable device for forming an image by electrophotography. It is to be noted that the number of various input-output devices (the display device 2, the image input device 4, the image forming apparatus 5, and the like), connected to the computer 1, is not limited to the number described above.

Figure 2:
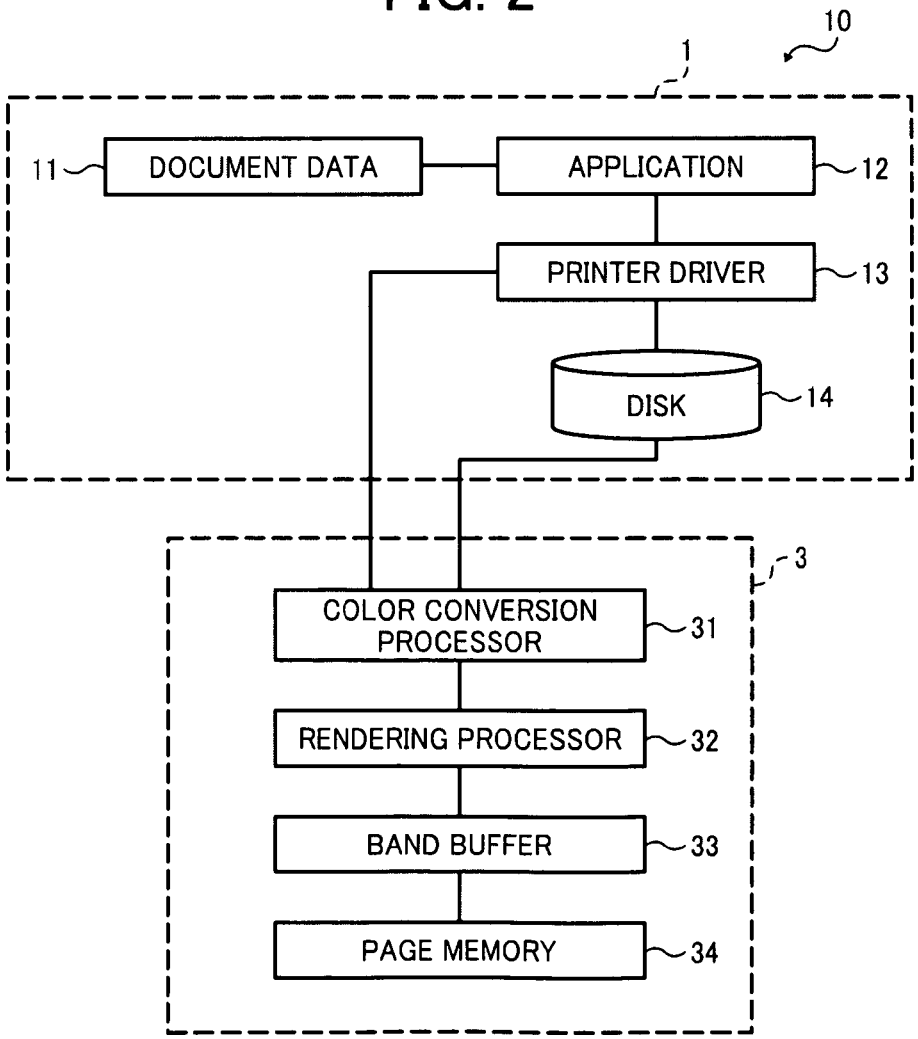
FIG. 2 is a schematic diagram of a computer and an image processor included in the image forming system shown in FIG. 1.

Referring to FIG. 2, a description is now given of functions of the computer 1 and the image processor 3. FIG. 2 is a schematic diagram of the computer 1 and the image processor 3. The computer 1 includes various types of application software 12, a printer driver 13, and a disk (storage device) 14. The image processor 3 includes a color conversion processor 31, a rendering processor 32, a band buffer 33, and a page memory 34.

The application software 12 generates data 11 such as document data or the like (hereinafter referred to as document data 11). The printer driver 13 performs processing necessary for the image forming apparatus 5 to print an image, for example, converts the document data 11 supplied from the application software 12 into a draw command performable by the image processor 3. The disk 14 stores the draw command from the printer driver 13.

The image processor 3 has the function of converting the draw command from the computer 1 into print data performable by the image forming apparatus 5. More specifically, the color conversion processor 31 performs color conversion of color data of an RGB type of the draw command transmitted to and received from the computer 1. The rendering processor 32 converts image data of a command type into image data of a raster type. The band buffer 33 stores the image data of a raster type. The page memory 34 stores the image data of a raster type stored in the band buffer 33. The color conversion processor 31 includes an adhesion processor, described later, for selectively setting an area to which adhesive toner adheres based on color information of CMY or the like.

Referring back to FIG. 1, operation of the image processing system 10 is described. In the image processing system 10, while the display device 2 displays image data stored in the computer 1, the computer 1 transmits the image data to the image processor 3 and transfers a processing result received from the image processor 3 to the image forming apparatus 5, and the image forming apparatus 5 forms a color image and outputs (prints) the image. In this case, the image data is a color signal including RGB color components for displaying a color image on a typical display device.

When the computer 1 transmits the RGB signal to the image processor 3, the image processor 3 converts the RGB signal into a CMYK signal composed of output color components being a control signal of the image forming apparatus 5. Simultaneously, the image processor 3 transfers data on an area to which adhesive toner adheres (hereinafter referred to as adhesion data) to the image forming apparatus 5. Therefore, the image forming apparatus 5 forms a color toner image and an image to which adhesive toner adheres and outputs a printing medium on which the color toner image and the adhesive toner are fixed.

Operation of the computer 1 generating a draw command to be transmitted to the image processor 3 and the image processor 3 performing image processing and outputting image data to the image forming apparatus 5 is described.

A user operates the computer 1 to edit image data displayed on the display device 2 using the application software 12 or the like. After finishing editing, the user specifies the image forming apparatus 5 to start to print the image using the application software 12. When the user starts to print the image using the application software 12 to order printing of the image using a printing property, the computer 1 transmits the image data to the printer driver 13 depicted in FIG. 2. The printer driver 13 converts the document data 11 into a draw command receivable by the image processor 3 and successively stores the draw command in the disk 14.

Upon receipt of the printing command from the computer 1, the image processor 3 reads out the draw command stored by the printer driver 13 in the disk 14 and transfers color data of the draw command to the color conversion processor 31 depicted in FIG. 2. The color conversion processor 31 performs predetermined color conversion processing and adhesion processing to convert the RGB color data into data of a type appropriate for the image forming apparatus 5 such as a color printer or the like. The rendering processor 32 depicted in FIG. 2 converts the command type data into raster image data, stores the raster image data in the band buffer 33, and allows the raster image data stored in the band buffer 33 to be stored in the page memory 34.

When the computer 1 reads out the image data (the tone data) stored in the page memory 34 of the image processor 3 and transfers the data to the specified image forming apparatus 5, the image forming apparatus 5 forms an image on a recording medium and outputs the recording medium.

According to this illustrative embodiment, the image processor 3 performs color conversion, adhesion processing, rendering processing, gradation processing and the like. However, these functions may be installed as software (a program) in the computer 1 being an information processor, provided as a dedicated processor such as an ASIC (application-specific integrated circuit), or installed in a controller, described later, of the image forming apparatus 5. Alternatively, a control device such as a dedicated print server, separated from the image forming apparatus 5, can perform the functions.

Figure 3A:
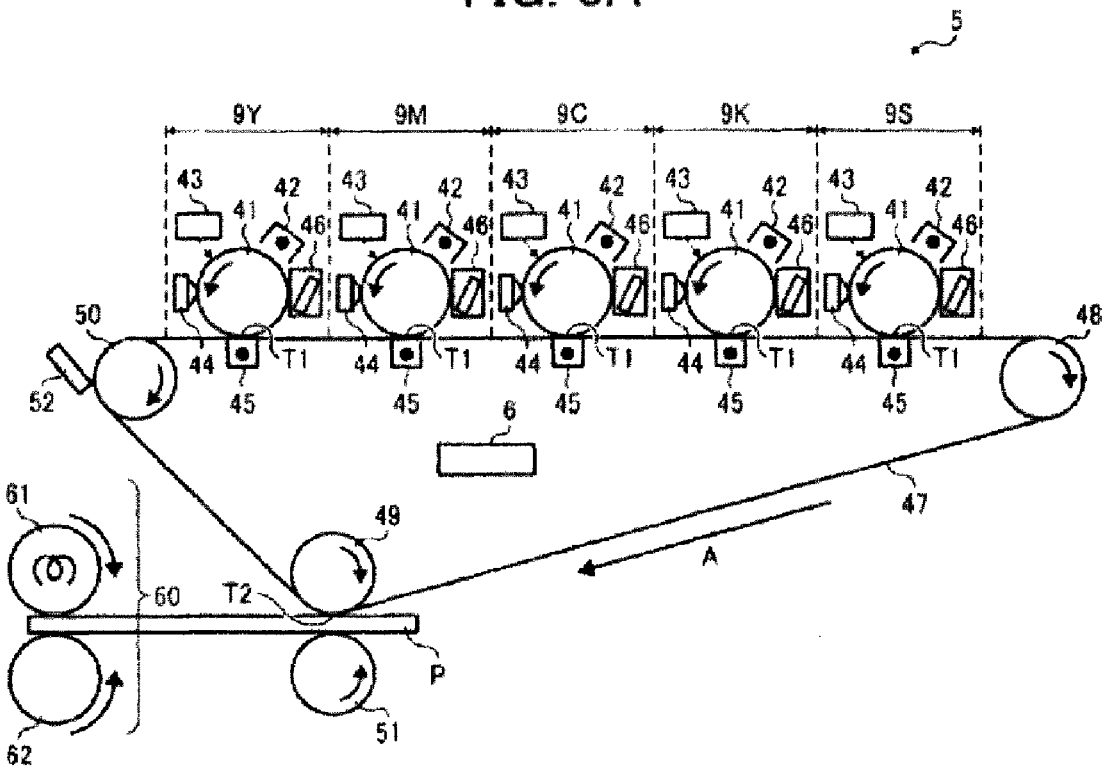
FIG. 3A is a schematic partial view of an image forming apparatus included in the image forming system shown in FIG. 1.
Figure 3B:
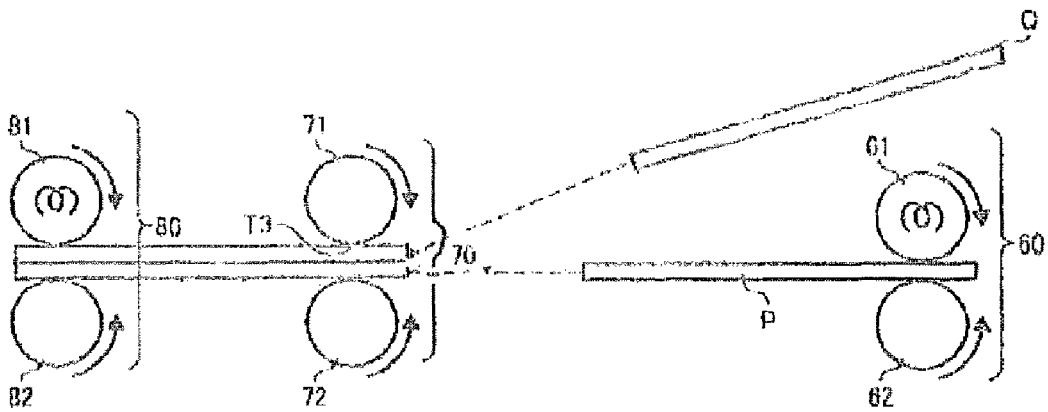
FIG. 3B is a partial view of the image forming apparatus shown in FIG. 3A.

Referring to FIGS. 3A and 3B, a description is now given of a structure of the image forming apparatus 5. FIG. 3A is a schematic partial sectional view of the image forming apparatus 5. FIG. 3B is another partial sectional view of the image forming apparatus 5. As illustrated in FIGS. 3A and 3B, the image forming apparatus 5 includes image forming units 9Y, 9M, 9C, and 9K, an image forming unit 9S, a first fixing device 60, a primary transfer device 45, an intermediate transfer belt 47, a driving roller 48, driven rollers 49 and 50, a secondary transfer device 51, an intermediate transfer belt cleaner 52, a controller 6, an alignment device 70, and a second fixing device 80. The image forming units 9Y, 9M, 9C, and 9K includes a photoconductor 41, a charger 42, an exposure device 43, a development device 44, and a photoconductor cleaner 46. The first fixing device 60 includes a fixing roller 61 and a pressing roller 62. The second fixing device 80 includes a fixing roller 81 and a pressing roller 82. The alignment device 70 includes rollers 71 and 72.

The image forming units 9Y, 9M, 9C, and 9K, serving as image formation devices, form four different color toner images with yellow, magenta, cyan, and black toner for image formation on a light-transmitting medium P, respectively. The image forming unit 9S, serving as an adhesion device, adheres adhesive toner to the light-transmitting medium P. The first fixing device 60 fixes the toner image on the light-transmitting medium P. The alignment device 70 aligns the light-transmitting medium P with a light-reflecting medium Q. The second fixing device 80 attaches the light-transmitting medium P to the light-reflecting medium Q. The first fixing device 60, the alignment device 70, and the second fixing device 80 together serve as a fixing device.

The image forming units 9Y, 9M, 9C, 9K, and 9S have the same structure and operation except that they use different toner.

The toner used in this embodiment is manufactured by a known manufacturing method. The yellow, magenta, cyan, and black toner for image formation each has an appropriate temperature for fixation of from about 160 degrees centigrade to about 190 degrees centigrade. The adhesive toner has an appropriate temperature for fixation of from about 110 degrees centigrade to about 190 degrees centigrade.

Operation of the image forming apparatus 5 is described with reference to FIGS. 3A and 3B.

The photoconductor 41, serving as an image carrier, is a drum-like electrophotographic photoconductor driven by a driving device to rotate counterclockwise in a direction A. The charger 42 uniformly charges a surface of the photoconductor 41 to a predetermined polarity and electrical potential. The exposure device 43 is provided downstream from the charger 42 in a direction of rotation of the photoconductor 41. In each of the image forming units 9Y, 9M, 9C, and 9K, the surface of the photoconductor 41 uniformly charged by the charger 42 is optically scanned based on drawing data transmitted from the image processor 3 depicted in FIG. 1, thereby forming an electrostatic latent image on the photoconductor 41.

In the image forming unit 9S, the surface of the photoconductor 41 uniformly charged by the charger 42 is optically scanned based on adhesion data transmitted from the image processor 3, thereby forming an electrostatic latent image on the photoconductor 41. The exposure device 43 is a laser scanner, a LED (light-emitting diode) array, or the like. The development device 44 is provided downstream from the exposure device 43 in the direction of rotation of the photoconductor 41, and develops the electrostatic latent image formed on the photoconductor 41 with toner. The primary transfer device 45 opposes the photoconductor 41 via the intermediate transfer belt 47 at a primary transfer position T1, and primarily transfers the toner image formed on the photoconductor 41 onto the intermediate transfer belt 47 due to a transfer electrical field generated by the primary transfer device 45. The photoconductor cleaner 46 removes residual toner remaining on the surface of the photoconductor 41 after transfer to the intermediate transfer belt 47 by the primary transfer device 45.

The image forming units 9Y, 9M, 9C, and 9K perform the same operation as described above, and form yellow, magenta, cyan, and black toner images, and an adhesive toner image, respectively. The toner images are sequentially transferred and superimposed at each primary transfer position T1, thereby forming an unfixed full color toner image formed by the yellow, magenta, cyan, and black toner images, as well as forming the adhesive toner image. The intermediate transfer belt 47 as an intermediate transfer body is wrapped around the driving roller 48 and the driven rollers 49 and 50, and driven to rotate in the direction A while contacting each photoconductor 41 of the image forming units 9Y, 9M, 9C, and 9K. The secondary transfer belt 51 opposes the driven roller 49 via the intermediate transfer belt 47 at a secondary transfer position T2. Due to a transfer electrical field generated by the secondary transfer device 51, when intermediate transfer belt 47 carrying the toner image reaches the secondary transfer position T2, the toner image formed on the intermediate transfer belt 47 is secondarily transferred onto the light-transmitting medium P, which is fed from a feeding device to the secondary transfer position T2.

After the full color toner image corresponding to a color image formed on an original document is formed as a mirror image on the light-transmitting medium P, the adhesive toner image is formed thereon. The intermediate transfer belt cleaner 52 removes residual toner remaining on the intermediate transfer belt 47 after transfer to a transfer material, that is, the light-transmitting medium P. The first fixing device 60 supplies the toner image formed on the transfer material with heat and pressure and fixes the toner image to the transfer material. A heater is provided inside the fixing roller 61 to control a temperature of the fixing roller 61.

The adhesive toner softens at a lower temperature than the yellow, magenta, cyan, and black toner for image formation. Since both the adhesive toner and the image forming toner have offset characteristics at a high temperature, the adhesive toner can be fixed at a temperature equal to that of the image forming toner. According to this illustrative embodiment, the first fixing device 60 sets a fixing temperature of about 180 degrees centigrade.

As illustrated in FIG. 3B, after being fed from the first fixing device 60, the light-transmitting medium P bearing the fixed color toner image is conveyed to the alignment device 70. When the light-reflecting medium Q is fed from a feeding device to an alignment position T3, as the light-transmitting medium P reaches the alignment position T3, the alignment device 70 aligns the light-transmitting medium P with the light-reflecting medium Q such that the light-reflecting medium Q contacts an adhesive surface of the light-transmitting medium P on which the adhesive toner is attached. The second fixing device 80 has the same function and structure as those of the first fixing device 70. When the second fixing device 80 supplies heat and pressure to the light-transmitting medium P and the light-reflecting medium Q aligned by the alignment device 70 to attach them to each other. More specifically, in the second fixing device 80, the adhesive toner exhibits adhesive property when the light-transmitting medium P and the light-reflecting medium Q are heated, and when the light-transmitting medium P and the light-reflecting medium Q are pressed against each other, they become attached to each other. A heater is provided inside the fixing roller 81 to control a temperature of the fixing roller 81. Since a temperature appropriate for fixation depends on an adhesive force required for fixation and a thermal capacity of a paper, the controller 6 of the image forming apparatus 5 can set and modifies a temperature of the fixing roller 81. According to this illustrative embodiment, the fixing roller 81 has a temperature of about 125 degrees centigrade. After fixation, a printing medium bearing the color toner image and the adhesive toner image is discharged to an output tray.

According to this illustrative embodiment, the image forming units 9Y, 9M, 9C, and 9K form a color toner image on the light-transmitting medium P, and the image forming unit 9S forms an adhesive toner image on the light-transmitting medium P. Then, the first fixing device 60 fixes the toner image on the light-transmitting medium P, and the second fixing device 80 attaches the light-transmitting medium P to the light-reflecting medium Q fed from a paper tray. Alternatively, however, the image forming units 9Y, 9M, 9C, and 9K may form and fix a color toner image on the light-transmitting medium P, and the image forming unit 9S may form and fix an adhesive toner image on the light-reflecting medium Q. Then, the light-transmitting medium P and the light-reflecting medium Q may be attached to each other.

Figure 4:
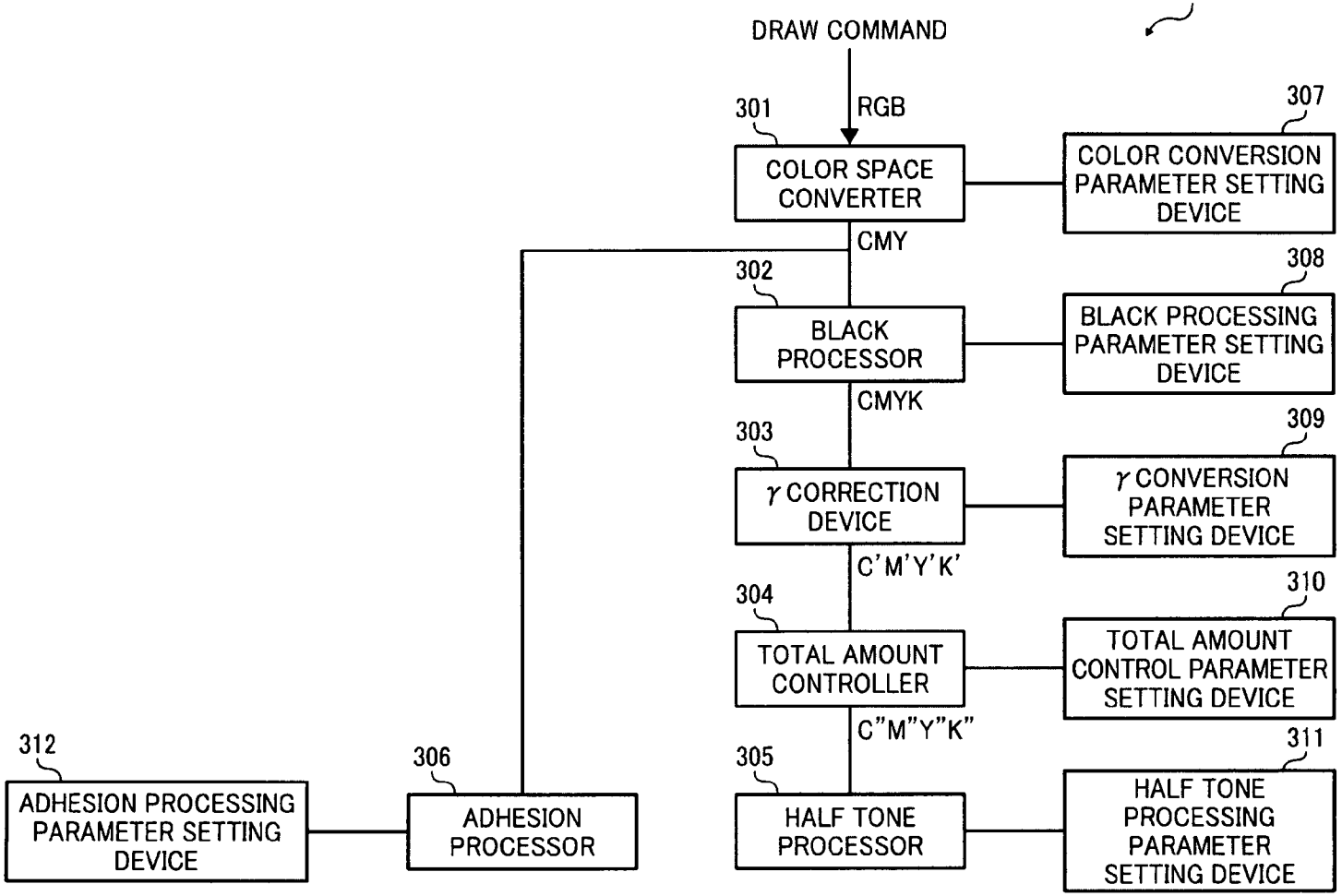
FIG. 4 is a block diagram of a color conversion processor included in the image processor shown in FIG. 2.

Referring to FIG. 4, a description is now given of a structure of the color conversion processor 31 according to this illustrative embodiment. FIG. 4 is a block diagram of the color conversion processor 31. The color conversion processor 31 includes a color conversion parameter setting device 307, a black processing parameter setting device 308, a γ conversion parameter setting device 309, a total amount control parameter setting device 310, a half tone processing parameter setting device 311, an adhesion processing parameter setting device 312, a color space converter 301, a black processor 302, a γ correction device 303, a total amount controller 304, a half tone processor 305, and an adhesion processor 306.

According to this illustrative embodiment, the color conversion processor 31 determines whether or not to attach a light-transmitting medium to a light-reflecting medium for each pixel based on information on a reproduced color of each pixel of input image data.

Due to the printer driver 13 of the computer 1, the color conversion parameter setting device 307 sets a color conversion parameter, the black processing parameter setting device 308 sets a black processing parameter, the γ conversion parameter setting device 309 sets a γ conversion parameter, the total amount control parameter setting device 310 sets a total amount control parameter, the half tone processing parameter setting device 311 sets a half tone processing parameter, and the adhesion processing parameter setting device 312 sets an adhesion processing parameter.

The color conversion processor 31 converts an input color signal (RGB type signal) transmitted from the computer 1 into a print color signal (CMY signal) using the color conversion parameter set by the color conversion parameter setting device 307. The black processor 302 converts the CMY signal component into a CMYK signal including a black toner component according to an UCR (under color removal) ratio or an UCA (under color addition) ratio. The γ correction device 303 corrects γ of the CMYK signal according to image forming engine characteristics and generates a C'M'Y'K' signal. The total amount controller 304 generates a C"M"Y"K" signal with respect to the C'M'Y'K' signal according to a maximum amount of a recording coloring agent with which the image forming apparatus 5 can form an image. The half tone processor 305 performs half tone processing (tone processing) such as dithering and converts the C"M"Y"K" signal into tone data (print data) which can be handled by the image forming apparatus 5. Based on the CMY signal, the adhesion processor 306, serving as an adhesion processing device, determines an area to which the adhesive toner adheres and transmits the adhesion data to the image forming apparatus 5.

Figure 5A:
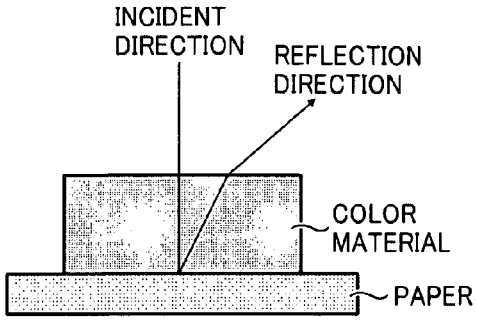
FIG. 5A is a sectional view of a reflection sample including a light-transmitting medium and a light-reflecting medium.
Figure 5B:
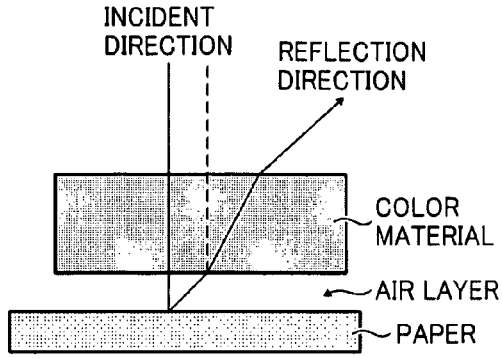
FIG. 5B is a sectional view of another reflection sample including a light-transmitting medium and a light-reflecting medium.

Referring to FIGS. 5A, 5B, 5C, 6, 7A, 7B, 8A, 8B, 9A, 9B, and 10, a description is now given of contact between a light-transmitting medium and a light-reflecting medium. FIG. 5A illustrates a reflection sample A including a coloring agent (e.g., toner) and a paper contacting with each other (hereinafter referred to as a contact state), and FIG. 5B illustrates a reflection sample B including a coloring agent and a paper without contacting with each other (hereinafter referred to as a noncontact state). The reflection sample A is created by a conventional electrophotographic method, whereas the reflection sample B allows an air layer to exist between the coloring agent and the paper.

Figure 5C:
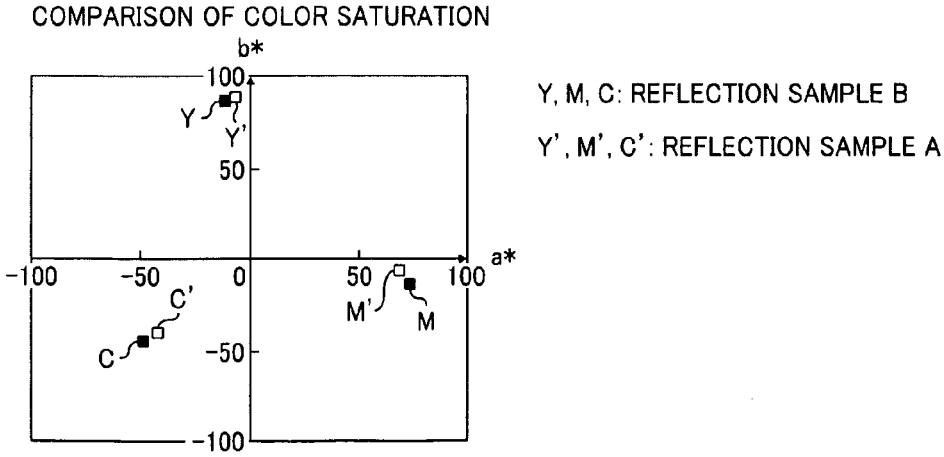
FIG. 5C is a graph illustrating a result of comparison of color saturation between the reflection samples shown in FIGS. 5A and 5B.

When cyan, magenta, and yellow solid images were formed on the light-transmitting medium using electrophotography both in the reflection samples A and B, saturation of each color was measured. FIG. 5C is a graph illustrating a result of comparison of color saturation. Each color saturation is plotted on a plane of a*, b* coordinate. Y', M', and C' indicate saturation of each toner color of the reflection sample A, whereas Y, M, and C indicate saturation of each toner color of the reflection sample B. The graph shows that each toner color Y, M, and C of the reflection sample B has greater saturation than that of each toner color Y', M', and C' of the reflection sample A.

Referring to FIGS. 6, 7A, 7B, 8A, 8B, 9A, 9B, and 10, a description is given of three reasons for the result of the comparison shown in FIG. 5C.

Figure 6:
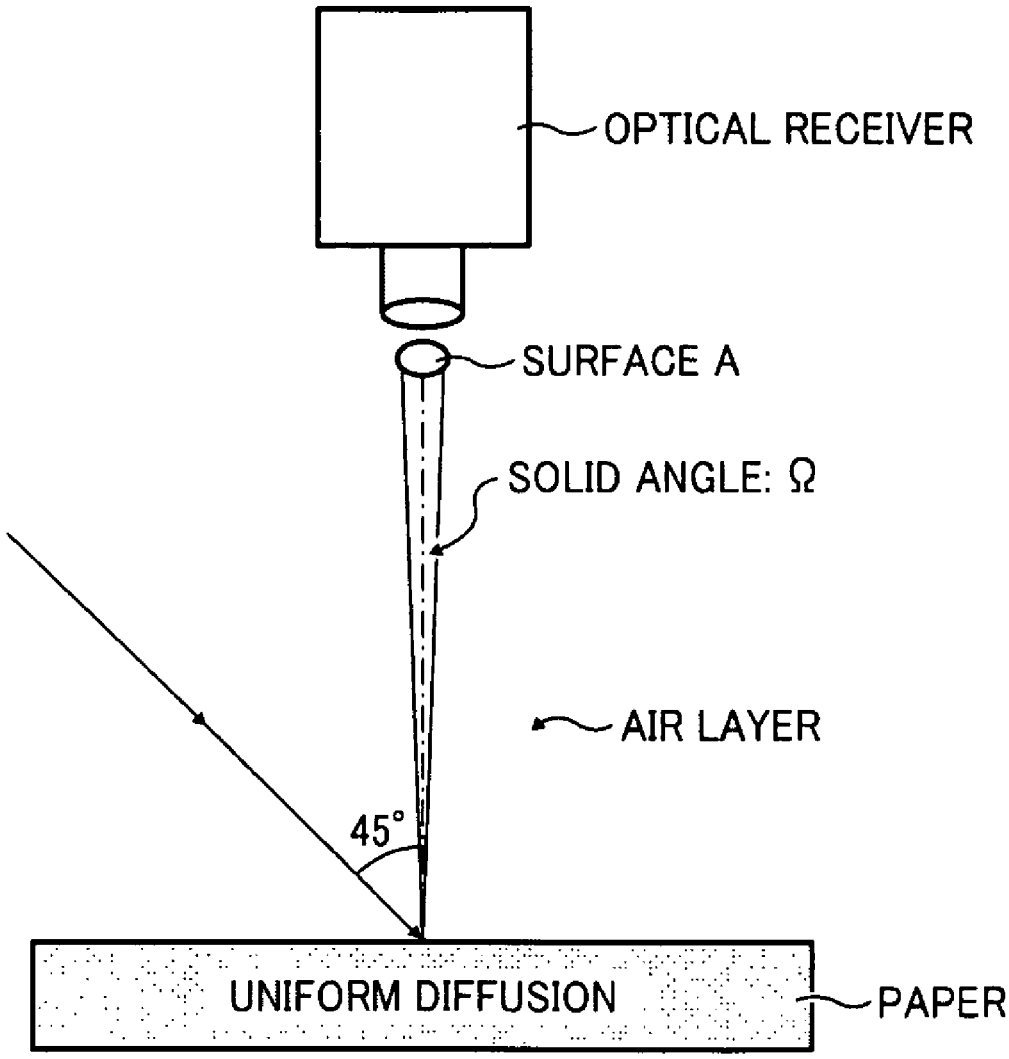
FIG. 6 is an illustration of the amount of light received by an optical receiver.
Figure 7A:
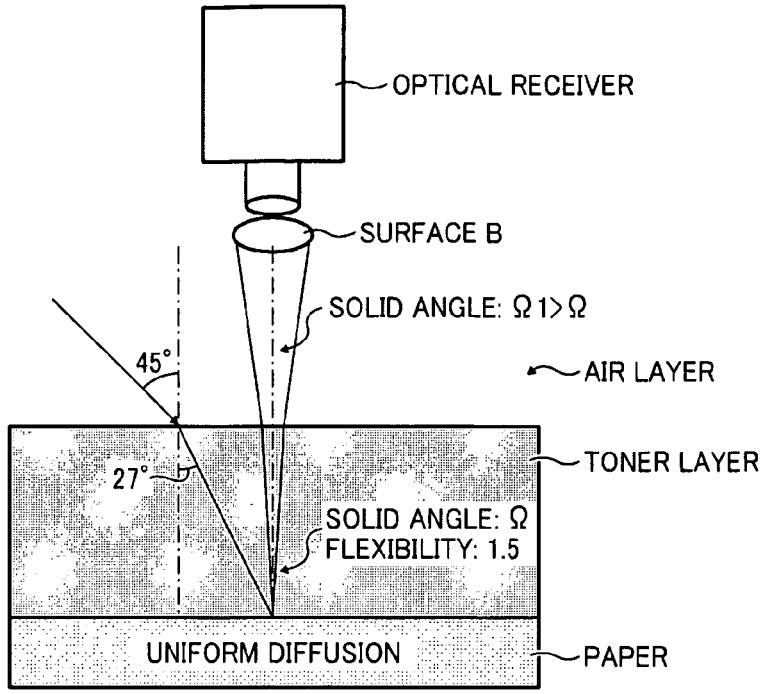
FIG. 7A is another illustration of the amount of light received by an optical receiver.
Figure 7B:
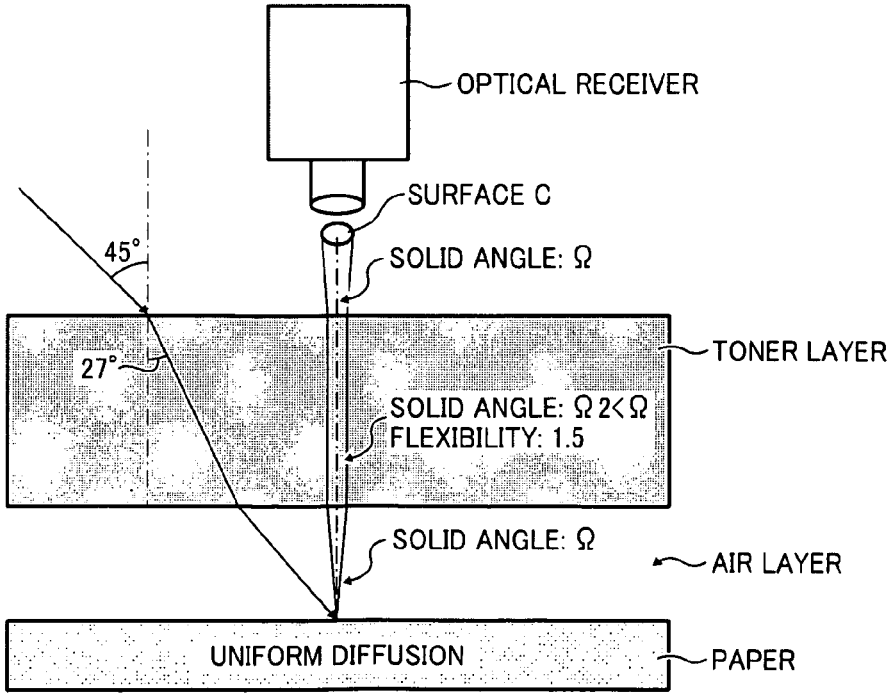
FIG. 7B is another illustration of the amount of light received by an optical receiver.

The first reason is described with reference to FIGS. 6, 7A, and 7B. FIGS. 6, 7A, and 7B illustrate an amount of light received by an optical receiver. The light is incident on a sheet of paper or a toner layer at an angle of 45 degrees, and the optical receiver receives the light at an angle of 0 degree. It is to be noted that these figures exclude a multiple reflection component, described later, and represent the first term in reflectance in Williams-Clapper model. FIG. 6 illustrates the light traveling through an air layer existing between the sheet of paper and the optical receiver. FIG. 7A illustrates the light traveling through a toner layer provided on a sheet of paper contacting the paper like the reflection sample A. FIG. 7B illustrates the light traveling through a toner layer provided above a sheet of paper without contacting the paper like the reflection sample B. In each case, light is uniformly diffused on the paper, and a luminous flux $\alpha$ is included in a solid angle $\Omega$. In FIG. 6, the diffused light propagates through air, and the luminous flux $\alpha$ passes through a surface A.

When the toner layer contacts the paper as illustrated in FIG. 7A, when the diffused light passes through the toner layer to the air layer, the diffused light expands to increase the solid angle $\Omega$ to $\Omega$1 ($>\Omega$) like a Fresnel lens while propagating through the air. As a result, the luminous flux $\alpha$ passes though a surface B $n^2$ times larger than the surface A, where n represents a refractive index of the toner layer. Therefore, light intensity (density) of FIG. 7A is smaller than light intensity of FIG. 6.

When the toner layer does not contact the sheet of paper as illustrated in FIG. 7B, when the diffused light passes through the air layer to the toner layer, the diffused light diminishes to cause the solid angle to decrease to $\Omega$2 ($<\Omega$) while propagating through the toner layer. Subsequently, when the light passes through the toner layer to the air layer, the solid angle $\Omega$2 returns to $\Omega$ in the air and propagates through the air again. As a result, the luminous flux $\alpha$ passes though a surface C having a same size as that of the surface A depicted in FIG. 6. That is, light intensity (density) of FIG. 7B is equivalent to light intensity (density) of FIG. 6. Therefore, the light intensity received by a measurement device (the optical receiver) per unit area of the noncontact state is greater than that of the contact state, and thus light reflectance of the noncontact state is greater than that of the contact state.

The above-described result was verified using a simple ray tracing method. When the refractive index of the toner layer was 1.5, a ratio of the amount of light reflectance of the noncontact state to the amount of light reflectance of the contact state was about 2.14.

Figure 8A:
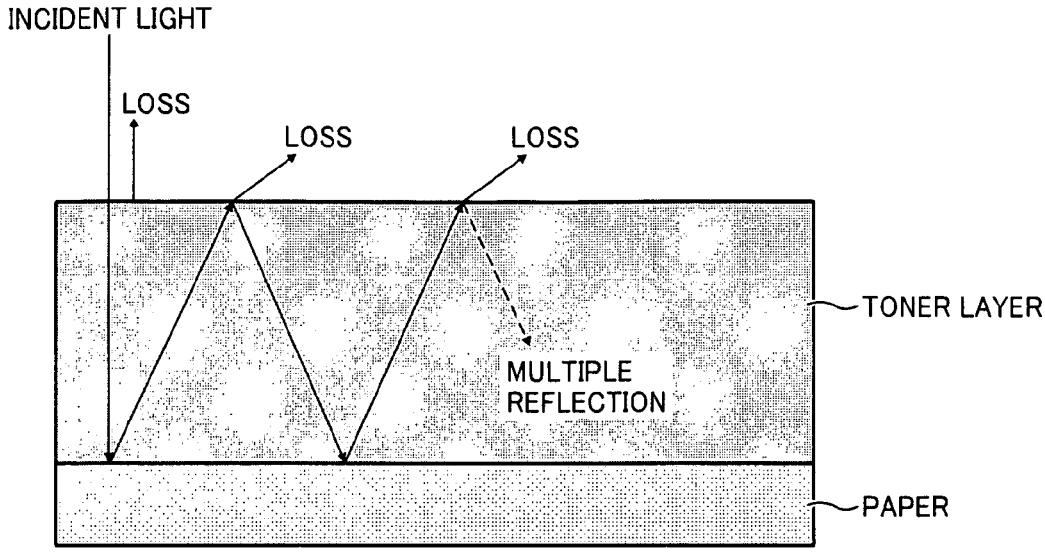
FIG. 8A is an illustration of multiple reflection of light.
Figure 8B:
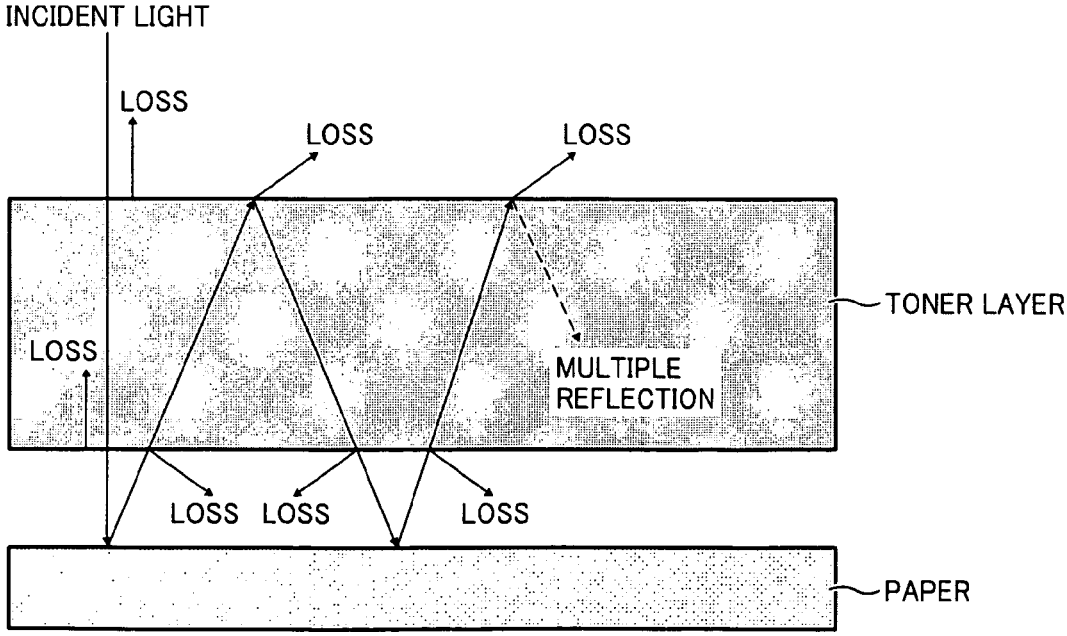
FIG. 8B is another illustration of multiple reflection of light.

The second reason is that the greater the ratio of the amount of multiple-reflected light to the amount of reflected light, the smaller the difference in light reflectance between the contact state and the noncontact state becomes. FIG. 8A illustrates multiple reflection of light in the contact state, and FIG. 8B illustrates multiple reflection of light in the noncontact state. According to the Williams-Clapper model, multiple-reflected light exists between an air layer and a toner layer, that is, light is reciprocally reflected therebetween. Due to Fresnel's internal reflection, transmitted light loses about 4% to 5% of the total at the interface between the air layer and the toner layer. Although the number of multiple reflections of FIGS. 8A and 8B is the same, since the number of Fresnel's internal reflections of FIG. 8B is greater than that of FIG. 8A, the transmitted light of FIG. 8B attenuates more quickly than the transmitted light of FIG. 8A. As a result, when the light is subjected to many multiple reflections, the ratio of the amount of light reflectance of the noncontact state to the amount of light reflectance of the contact state further decreases. That is, the greater the ratio of the amount of multiple-reflected light to the amount of reflected light, the smaller the difference in light reflectance between the contact state and the noncontact state becomes.

Figure 9A:
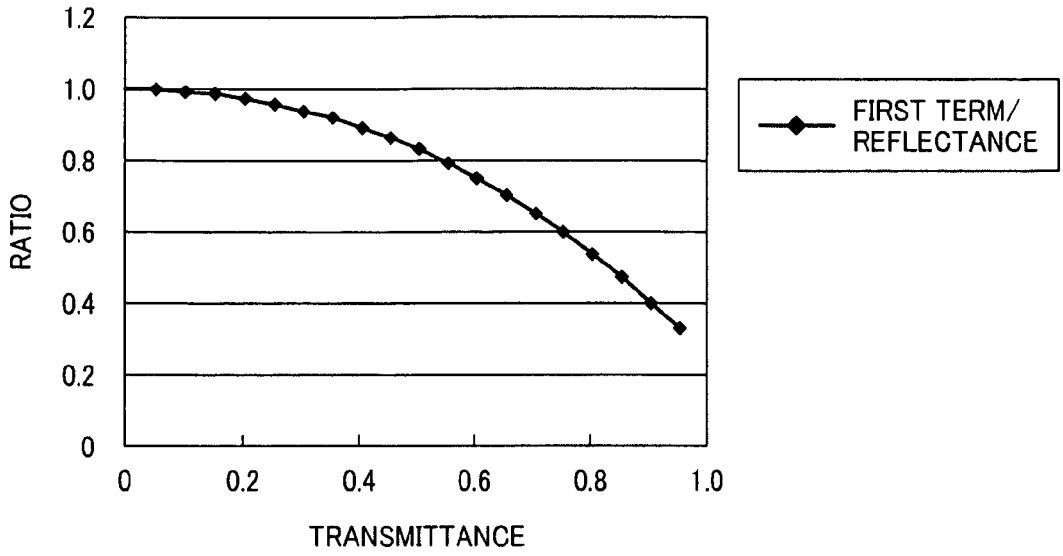
FIG. 9A is a graph illustrating a relation between transmittance and multiple reflections.

The third reason is that the greater the light transmission rate of the toner layer, the greater the ratio of the amount of multiple-reflected light to the amount of the total reflected light. FIG. 9A is a graph illustrating a result of calculation of a ratio of the first term (no multiple reflection) to the light reflectance for each transmittance value using Williams-Clapper model, with the transmittance on the horizontal axis and the ratio of the first term on the vertical axis. As illustrated in FIG. 9A, the greater the transmittance of the toner layer, the smaller the ratio of the first term. That is, the greater the light transmission rate of the toner layer, the greater the ratio of the amount of multiple-reflected light to the amount of the total reflected light.

Considering the above-described reasons, the amount of the light reflectance of the noncontact state is about twice as large as the amount of the light reflectance of the contact state in an absorption band of the toner layer. As the transmittance of the toner layer increases, the ratio of the amount of the light reflectance of the noncontact state to the amount of the light reflectance of the contact state decreases. It is to be noted that the absorption band of the toner layer is an absorption band in the reflection sample, and a transmissive band of the toner layer is a reflective band in the reflection sample.

Figure 9B:
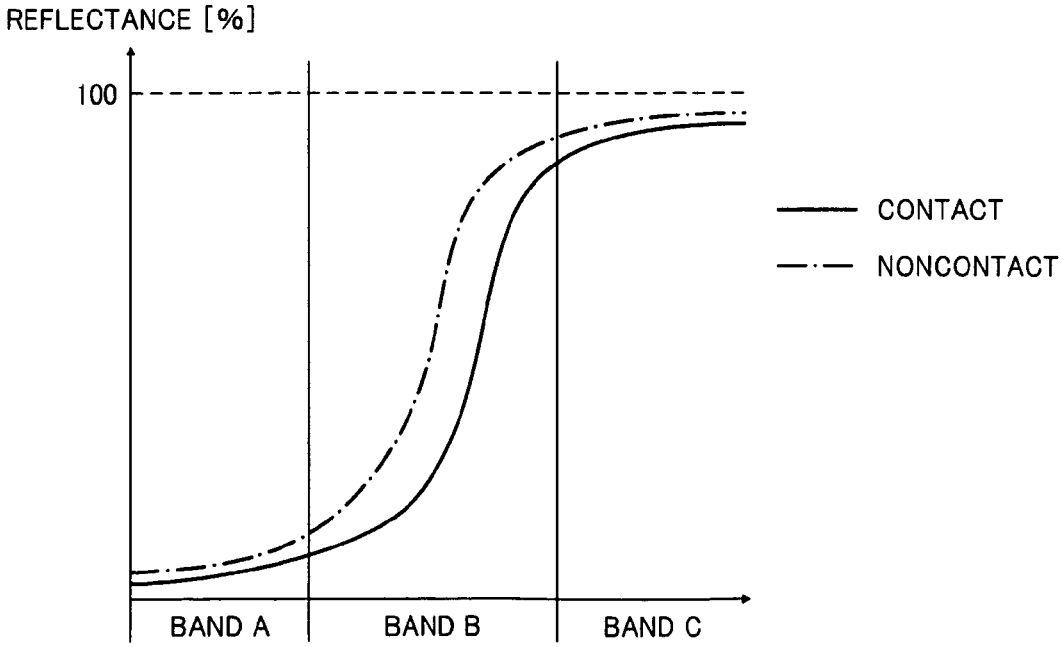
FIG. 9B is a graph showing a comparison of a change in reflectance.

FIG. 9B is a graph illustrating comparison of a change in reflectance between the contact state (represented by solid line) and the noncontact state (represented by broken line). The band A is an absorptive band with low reflectance, the band B is an intermediate band with medium reflectance, and the band C is a reflective band with high reflectance. In both the contact and noncontact states, in the band C, since the ratio of the amount of multiple-reflected light to the total amount of reflected light is large, the amount of change in the reflectance is small. In the band B, the reflectance of the noncontact state increases at a rate greater than that of the contact state. In the band A, since the ratio of multiple-reflected light to the total amount of reflected light is small, the reflectance of the noncontact state increases substantially twice as high as that of the contact state. However, since the reflectance of the contact state is initially low, the amount of difference in the reflectance is small. Thus, the amount of change in the reflectance seems small in percentage terms. Therefore, the amount of change in reflectance increases most significantly in the band B.

A relation between spectral reflectivity and saturation is now described.

In order to increase saturation, that is, in order to increase the a*−b* value as described above with reference to FIG. 5C, the amount of difference in spectral reflectivity between a reflective band and an absorptive band needs to be large. That is, the reason why saturation increases when the contact state changes to the noncontact state is that the reflectivity changes little in the absorptive band and increases in the reflective band.

Figure 10:
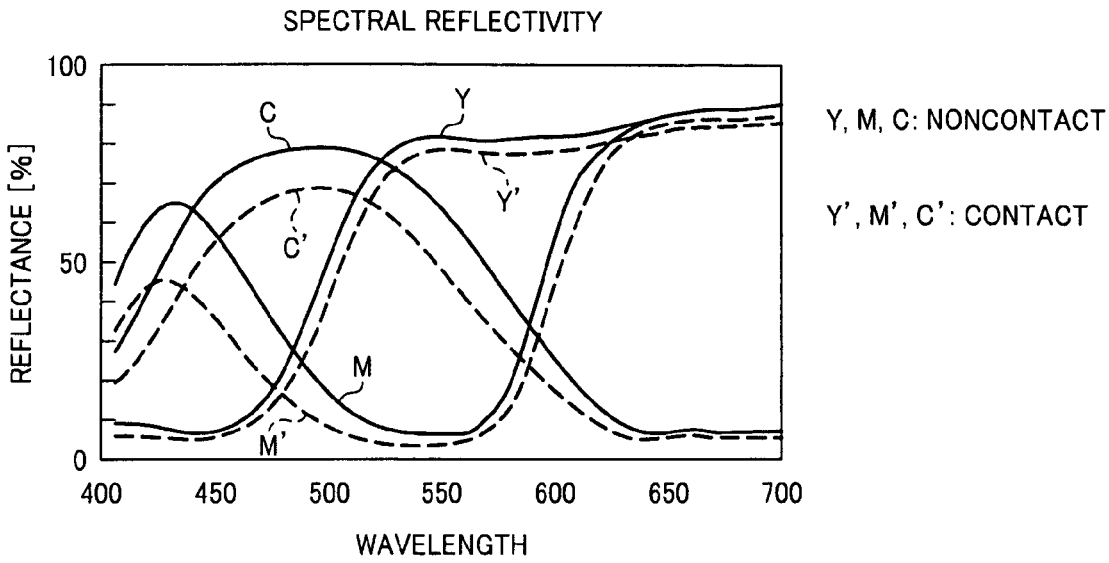
FIG. 10 is a graph of spectral reflectivity.

FIG. 10 illustrates comparison of spectral reflectivity of yellow, magenta, and cyan toner between the contact state and the noncontact state. As can be seen therefrom, saturation of the cyan toner significantly increases. Although a coloring agent with low reflectance in the reflective band (e.g., a band of from about 420 nm to about 570 nm for the cyan toner) exhibits a low degree of saturation and color reproducibility, when the coloring agent does not contact a light-reflecting medium, saturation of the cyan toner C increases due to the above-described reason. In addition, the same can be said for secondary colors.

Figure 11:
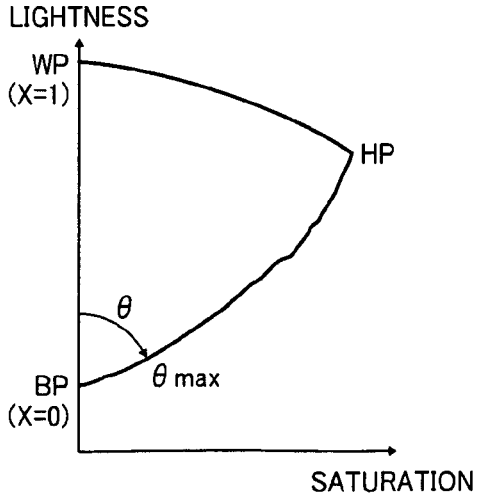
FIG. 11 is a graph of a color gamut for a printer on a same hue.

Referring to FIG. 11, a description is now given of determination of whether or not to make a light-transmitting medium contact a light-reflecting medium. FIG. 11 is a graph illustrating a color gamut for a printer on the same hue. Saturation is plotted on the lateral axis, and lightness is plotted on the vertical axis. As described above with reference to FIGS. 5A through 10, when a light-transmitting medium does not contact a light-reflecting medium, color reproducibility is improved. As illustrated in FIG. 11, a color with the most saturation, that is, HP (a highlight point) is the most reproducible.

The adhesion processor 306 depicted in FIG. 4, serving as an adhesion processing device, determines whether or not to make a light-transmitting medium optically contact a light-reflecting medium. The adhesion processor 306 makes this determination based on several criteria, described below.

The first criterion is not to make a light-transmitting medium contact a light-reflecting medium in the vicinity of the most saturated point HP in order to increase saturation.

The second criterion is not to make a light-transmitting medium contact a light-reflecting medium in the vicinity of WP (a white point) depicted in FIG. 11, so as to increase reflectance thereof, thereby making a white part of paper look whiter except when unnecessary.

The third criterion is to make a light-transmitting medium contact a light-reflecting medium in the vicinity of BP (a black point) depicted in FIG. 11, so as to decrease reflectance thereof, thereby making a black part of paper look blacker. It is to be noted that the black point is a black color reproducible by a printer.

Figure 12A:
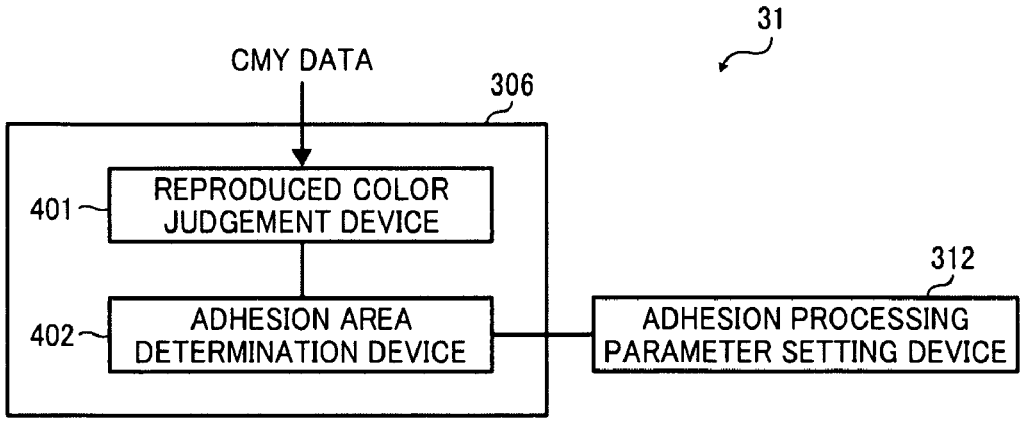
FIG. 12A is a block diagram of an adhesion processor included in the color conversion processor shown in FIG. 4.
Figure 12B:
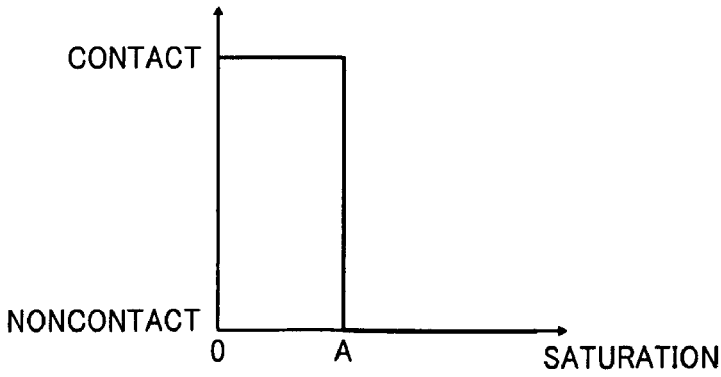
FIG. 12B is a graph of a rectangular function as an example of an adhesion processing parameter.

Referring to FIGS. 12A and 12B, a description is now given of a structure of the adhesion processor 306 according to this illustrative embodiment. FIG. 12A is a block diagram of the adhesion processor 306 and the adhesion processing parameter setting device 312. The adhesion processor 306 includes a reproduced color judgment device 401 and an adhesion area determination device 402.

Based on the above-described criteria, the adhesion processor 306 determines whether or not to make a light-transmitting medium contact a light-reflecting medium for each pixel. The reproduced color judgment device 401 obtains a saturation value or a lightness value based on CMY data. An example of a saturation value is a chroma value defined as a distance between an original point and chromatic coordinates (a*, b*) in the CIE1976L*a*b* color space. An example of lightness is a lightness value in the CIE1976L*a*b* color space.

The adhesion area determination device 402 retrieves an adhesion processing parameter from the adhesion processing parameter setting device 312 and determines whether or not to make a light-transmitting medium contact a light-reflecting medium for each pixel based on the saturation value obtained by the reproduced color judgment device 401. Then, the adhesion area determination device 402 outputs binary image data of whether or not to make a light-transmitting medium contact a light-reflecting medium, which is transmitted to the image forming apparatus 5 depicted in FIG. 1.

The adhesion processing parameter is a rectangular function with an input value being a saturation value or a lightness value, for example. FIG. 12B is a graph of a rectangular function as an example of the adhesion processing parameter using a saturation value as an input value. When a saturation value smaller than a predetermined value A is input, the rectangular function returns determination to make a light-transmitting medium contact a light-reflecting medium, and when a saturation value greater than or equal to the predetermined value A is input, the rectangular function returns determination not to make a light-transmitting medium contact a light-reflecting medium. Alternatively, a value 1 may be set for determination to make a light-transmitting medium contact a light-reflecting medium, and a value 0 may be set for determination not to make a light-transmitting medium contact a light-reflecting medium. Alternatively, the adhesion processing parameter may define a determination table or threshold determination in which a saturation value or a lightness value is input.

Figure 13:
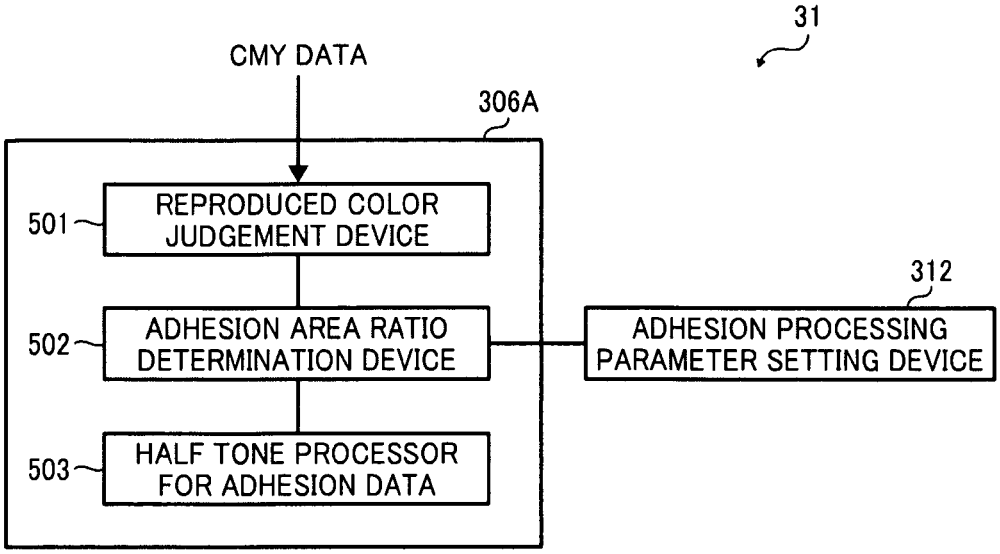
FIG. 13 is a block diagram of an adhesion processor according to another illustrative embodiment of the present disclosure.
Figure 14:
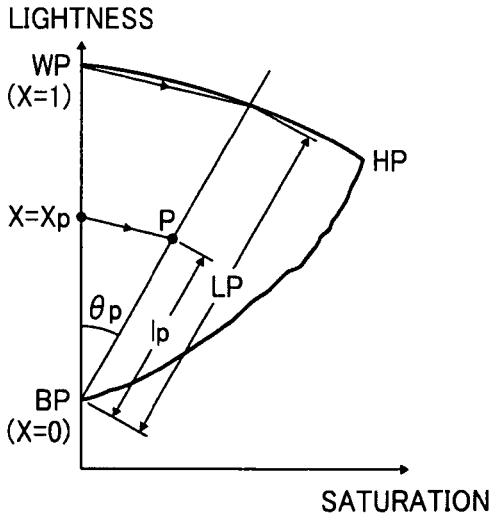
FIG. 14 is a graph of a color gamut showing a coordinate point P.

Referring to FIGS. 13, 14, 15, 16A, and 16B, a description is now given of determination of a ratio of an adhesive toner adhesion area for each n×m pixel of input image data using color information according to another illustrative embodiment. FIG. 13 is a schematic diagram of an adhesion processor 306A. FIG. 14 is a graph of a color gamut showing a coordinate point P.

The adhesion processor 306A, serving as an adhesion processing device, includes a reproduced color judgment device 501, an adhesion area ratio determination device 502, and a half tone processor for adhesion data 503. The reproduced color judgment device 501 obtains a color coordinate point P of a reproduced color in the CIE1976L*a*b* color space from CMY data input for each pixel. The adhesion area ratio determination device 502 obtains data of a ratio of adhesion area to which adhesive toner adheres for an n×m pixel area from the coordinate point. Since image data obtained by the adhesion area ratio determination device 502 is multi-valued, the half tone processor for adhesion data 503 binarizes the image data and transmits the binarized image data as image data for adhesion to the image forming apparatus 5 depicted in FIG. 1. It is to be noted that binarization may use a known dithering method.

Figure 15:
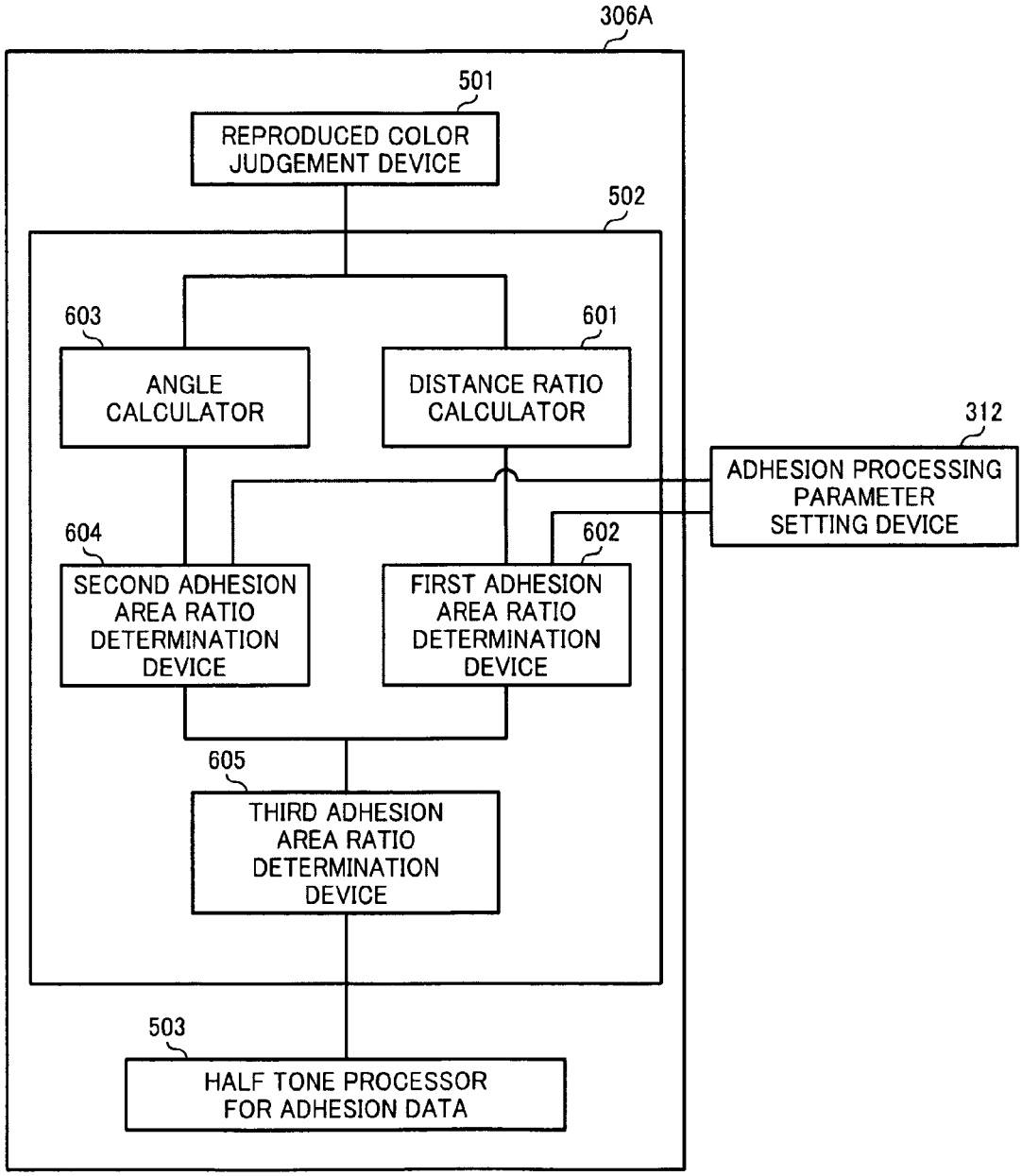
FIG. 15 is a block diagram of an adhesion area ratio determination device included in the adhesion processor shown in FIG. 13.

FIG. 15 is another schematic diagram of the adhesion processor 306A. The adhesion area ratio determination device 502 includes a distance ratio calculator 601, a first adhesion area ratio determination device 602, an angle calculator 603, a second adhesion area ratio determination device 604, and a third adhesion area ratio determination device 605.

The distance ratio calculator 601 calculates a distance ratio Xp from the coordinate point P depicted in FIG. 14. The first adhesion area ratio determination device 602 retrieves the adhesion processing parameter from the adhesion processing parameter setting device 312 to determine a first adhesion area ratio fx (Xp) for the distance ratio Xp. Simultaneously, when the angle calculator 603 calculates an angle θp from the coordinate point P, the second adhesion area ratio determination device 604 retrieves the adhesion processing parameter from the adhesion processing parameter setting device 312 to determine a second contact area ratio fθ (θp) for the angle θp. The third area ratio determination device 605 calculates a third adhesion area ratio obtained by multiplication of the first adhesion area ratio fx (Xp) and the second adhesion area ratio fθ (θp).

Figure 16A:
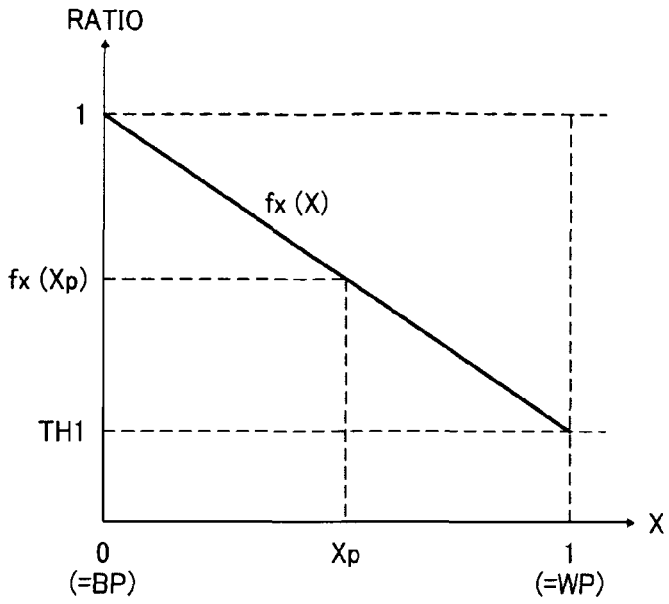
FIG. 16A is a graph of a function for calculating a first adhesion area ratio.
Figure 16B:
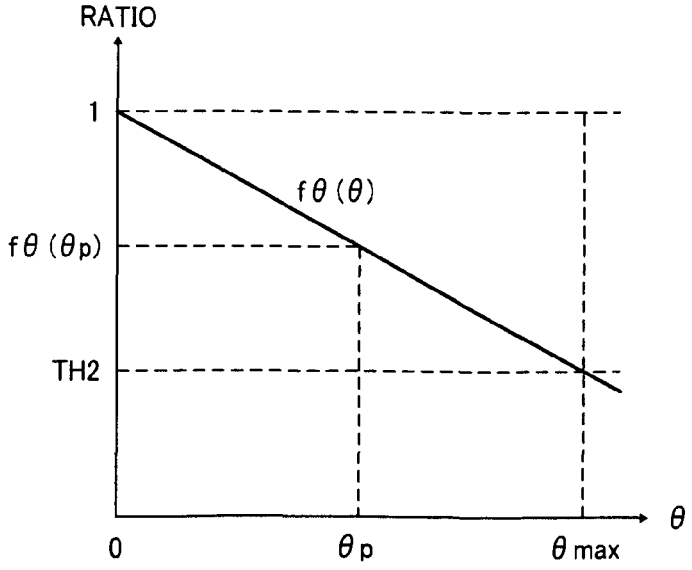
FIG. 16B is a graph of a function for calculating a second adhesion area ratio.

Referring to FIGS. 16A and 16B, a description is given of determination of the third adhesion area ratio according the above-described criteria with reference to FIG. 11.

As illustrated in FIG. 11, a coordinate axis X extends from the BP as an original point toward the WP. Thus, the x coordinate value of the BP is 0 (X=0), and the x coordinate value of the WP is 1 (X=1). In addition, when a rotating coordinate axis θ is set, θmax represents an angle formed by the WP, BP, and HP.

FIG. 16A is a graph of a function fx (X) for calculating a first adhesion area ratio for X. FIG. 16B is a graph of a function fθ (θ) for determining a second adhesion area ratio for θ. A third adhesion area ratio is obtained by multiplication of the first adhesion area ratio and the second adhesion area ratio, that is, a product of the function fx (X) and the function fθ (θ) For example, the adhesion area ratio for the BP is calculated by the following formula (1)

$$fx(X)\times f\theta(\theta)=1 \quad (1)$$

where X=0 and θ=0. Therefore, the adhesion area ratio for the BP is 100%.

The adhesion area ratio for the WP is calculated by the following formula (2)

$$fx(X)\times f\theta(\theta)=TH1\ (0\leqq TH1\leqq 1) \quad (2)$$

where X=1 and θ=0.

The adhesion area ratio for the HP is calculated by the following formula (3)

$$fx(X)\times f\theta(\theta)=TH1\times TH2\ (0\leqq TH2\leqq TH1) \quad (3)$$

where X=1 and θ=θmax. It is to be noted that TH1×TH2 represents a minimum area ratio for combining a light-transmitting medium and a light-reflecting medium.

Referring back to FIG. 14, the adhesion area ratio for the particular point P on the color coordinate is calculated as follows.

The distance ratio calculator 601 depicted in FIG. 15 calculates a distance ratio Xp, which is represented as Xp=(Ip/Lp) where Ip represents a distance between the BP and the point P and Lp represents a distance between the BP and an intersection point of a line extended from the distance Ip and an outmost of the color gamut. Then, the angle calculator 603 depicted in FIG. 15 calculates an angle θp depicted in FIG. 14. Thereafter, the first adhesion area ratio determination device 602 depicted in FIG. 15 calculates the first adhesion area ratio fx (Xp) for the input Xp based on the function fx (X) depicted in FIG. 16A. The second adhesion area ratio determination device 604 depicted in FIG. 15 calculates the adhesion area ratio fθ (θp) for the input θp based on the function fθ (θ) depicted in FIG. 16B. Thereafter, the third area ratio determination device 605 depicted in FIG. 15 calculates the formula fx (Xp)×fθ (θp) as an adhesion area ratio for the point P, thereby determining the adhesion area ratio for the reproduced color in the n×m pixel.

As an example of the adhesion processing parameter, the functions fx (X) and fθ (θ), and a conversion table of the vertical axis (ratio) relative to the lateral axis (X, θ) depicted in FIGS. 16A and 16B are stored. The function fx (X) determines an adhesion area ratio for input lightness, and the function fθ (θ) determines an adhesion area ratio for input saturation. By using the third adhesion area ratio obtained by calculating fx (Xp)×fθ (θp), continuity of the adhesion area ratio can be maintained between the WP and the HP, and between the HP and the BP.

According to this illustrative embodiment, the adhesive toner adhesion area ratio is determined based on color information on each area of the input image, and the adhesion area ratio is determined based on the input CMY signal. Alternatively, for example, the adhesion area ratio may be determined based on the C"M"Y"K" signal generated by the total amount controller 304 depicted in FIG. 4. Although the functions fx (X) and fθ (θ) depicted in FIGS. 16A and 16B are linear functions, the functions fx (X) and fθ (θ) may be nonlinear. However, as the lateral axes (X, θ) increase, the functions fx (X) and fθ (θ) need to be monotone decreasing functions. The functions fx (X) and fθ (θ) that are an adhesion processing parameter may be determined for each hue.

Referring to FIGS. 17, 18A, 18B, 18C, 19A, 19B, 20, and 21, a description is now given of selection and determination of a dot position to which adhesive toner adheres based on N value (N≧3) image data after half tone processing according to yet another illustrative embodiment.

Figure 17:
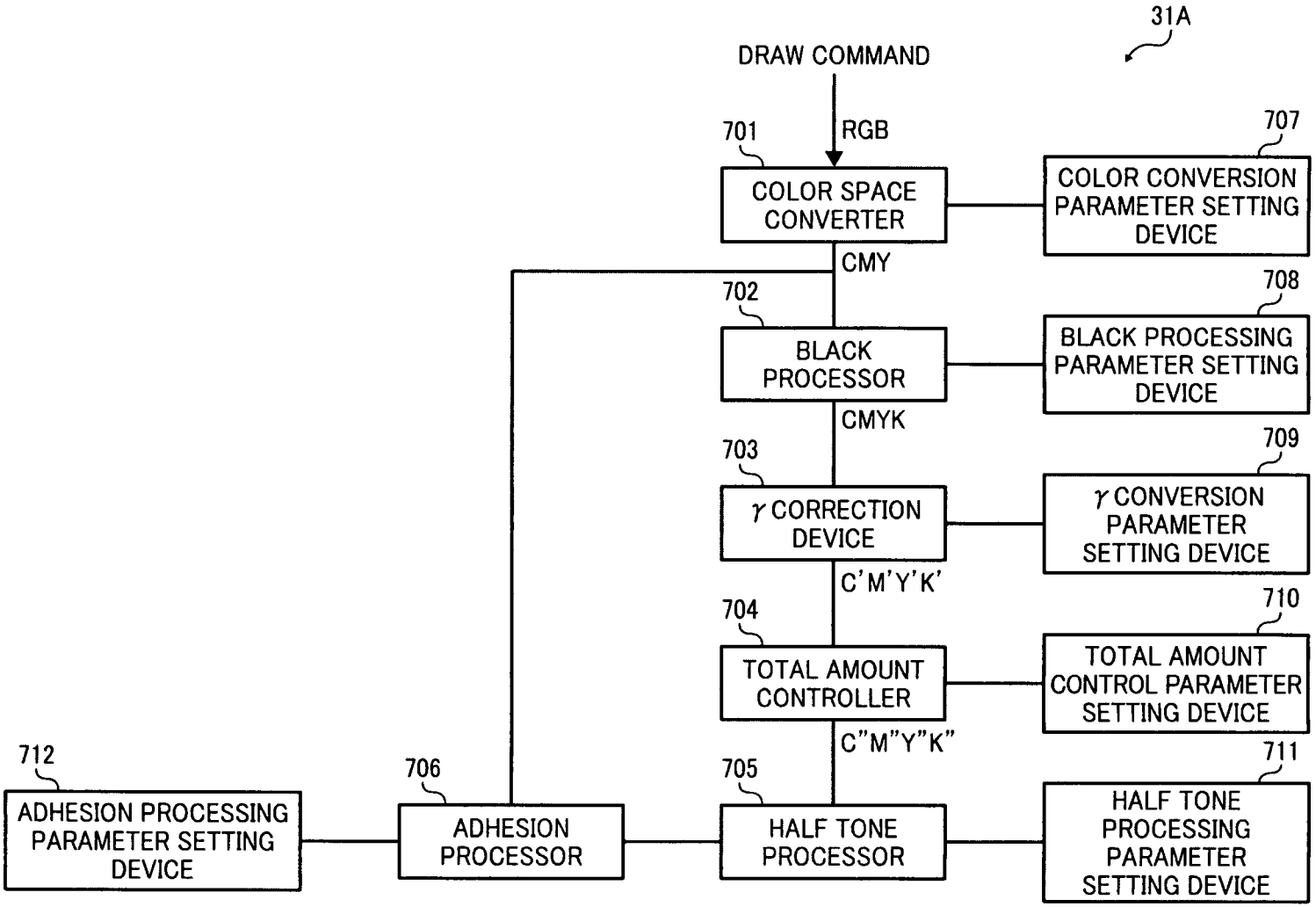
FIG. 17 is a block diagram of a color conversion processor according to yet another illustrative embodiment of the present disclosure.

FIG. 17 is a block diagram of a color conversion processor 31A. The color conversion processor 31A includes a color conversion parameter setting device 707, a black processing parameter setting device 708, a γ conversion parameter setting device 709, a total amount control parameter setting device 710, a half tone processing parameter setting device 711, an adhesion processing parameter setting device 712, a color space converter 701, a black processor 702, a γ correction device 703, a total amount controller 704, a half tone processor 705, and an adhesion processor 706.

Figure 18A:
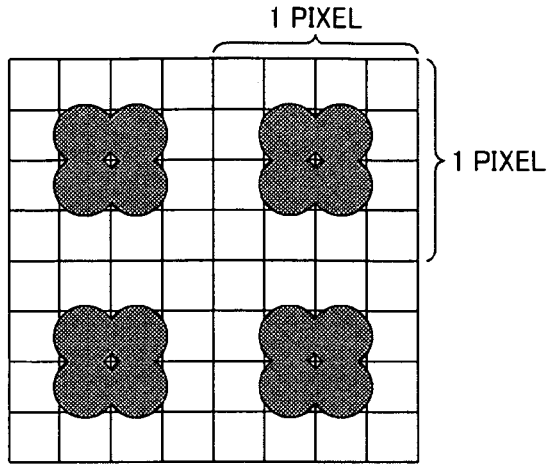
FIG. 18A is an illustration of an example of a gray-scale image.
Figure 18B:
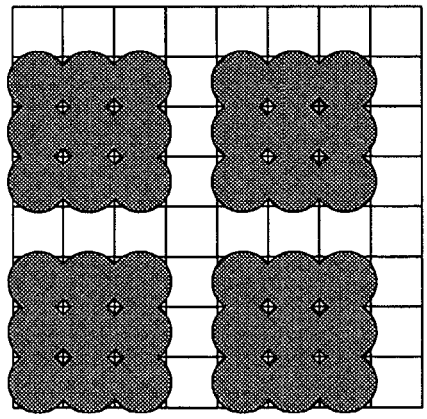
FIG. 18B is an illustration of another example of the gray-scale image.
Figure 18C:
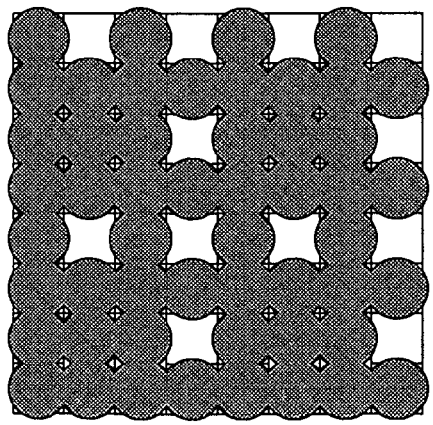
FIG. 18C is an illustration of yet another example of the gray-scale image.

FIG. 18A illustrates a low-density portion of a gray-scale image, FIG. 18B illustrates a medium-density portion of the gray-scale image, and FIG. 18C illustrates a high-density portion of the gray-scale image. Each image includes 4 pixels, each of which has 16 shades of gray (four value). Each black dot indicates a dot-on state.

The adhesion processor 706, serving as an adhesion processing device, determines a dot position to which adhesive toner adheres based on N value data after half tone processing and color information of each pixel. The half tone processor 705 converts multi-valued data (M value>N value) into the N value data. Thus, for example, dots as illustrated in FIG. 18A are generated in the low-density portion of the image. For example, dots as illustrated in FIG. 18B are generated in the middle-density portion of the image. For example, dots as illustrated in FIG. 18C are generated in the high-density portion of the image.

Figure 19A:
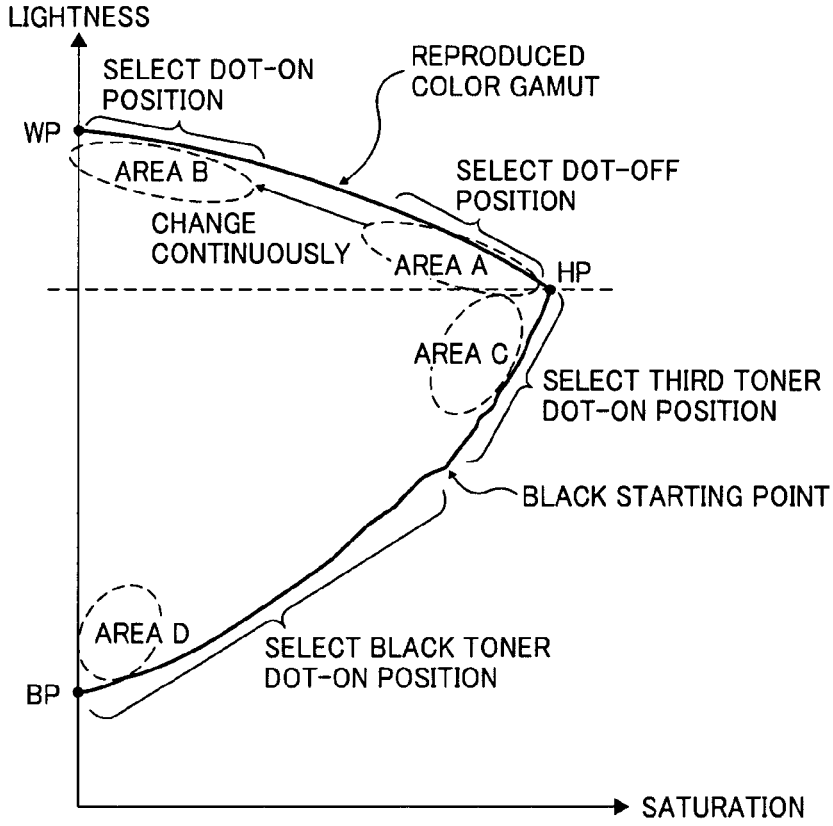
FIG. 19A is a graph of a color gamut for a printer illustrating choice of a dot position.

FIG. 19A is a graph of a color gamut for a printer on a same hue, illustrating how the adhesion processor 706 determines a dot position to which adhesive toner is attached (adheres) for each pixel as follows.

In the vicinity of the most saturated point, that is, a HP (highlight point) depicted in FIG. 19A, since preferably a light-transmitting medium and a light-reflecting medium do not contact each other in order to increase saturation, the adhesion processor 706 chooses a position to which color toner is not attached (a dot-off position) and attaches adhesive toner to that dot-off position.

In the vicinity of a WP (white point) depicted in FIG. 19A, since preferably a light-transmitting medium and a light-reflecting medium do not contact each other, the adhesion processor 706 chooses a position to which color toner is attached (a dot-on position) and attaches adhesive toner to that dot-on position.

When three or more colors of toner are attached to a shadow portion, preferably adhesive toner is attached to the dot position. By making a light-transmitting medium contact a light-reflecting medium, when more than three or more colors of toner are superimposed, lightness merely decreases, although a secondary color decreases in saturation. The same can be said for black toner. It is to be noted that spectral characteristics of more than three superimposed colors need to be substantially flat.

In areas other than the above, the adhesion processor 706 can choose any dot position to which adhesive toner adheres. That is, since a color conversion table can adjust a color inside the gamut regardless of contact or noncontact, the adhesion processor 706 can choose any dot position to which adhesive toner adheres.

Figure 19B:
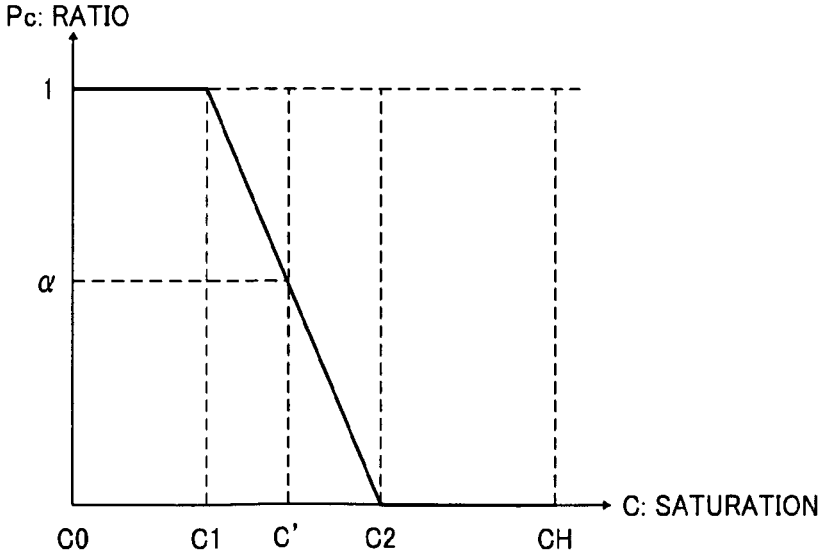
FIG. 19B is a graph illustrating a ratio of choice of a dot position relative to a degree of saturation.

Referring to FIG. 19B, a description is given of determination of a dot position to which adhesive toner adheres when a reproduced color belongs to a highlight area with greater lightness than that of the HP depicted in FIG. 19A. FIG. 19B is a graph illustrating a relation between a ratio at which the adhesive toner adheres to a dot position to which color toner is attached and a degree of saturation. The degree of saturation C is plotted on the lateral axis, and the ratio Pc is plotted on the vertical axis. It is to be noted that CH on the saturation coordinate represents a saturation value of the HP depicted in FIG. 19A.

Since the adhesive toner adhesion area ratio is determined according to color information as described above, the adhesion area ratio for each pixel is determined. The adhesion area ratio is represented by the following formula (4)

$$fx(X)\times f\theta(\theta)=R \quad (4)$$

As illustrated in FIGS. 18A, 18B, and 18C, when each pixel has 16 dots (16 shades of gray), the adhesion area ratio is calculated in 1/16 unit and rounded off in numerical calculations.

As to a color with low saturation belonging to an area B depicted in FIG. 19A corresponding to $C0 \leqq C < C1$ in FIG. 19B, dots are generated as illustrated in FIG. 18A. That is, the number of dot-off positions is greater than the number of dot-on positions. Since the ratio Pc=1 as illustrated FIG. 19B, the adhesion processor 706 chooses a dot-on position to adhere adhesive toner. More specifically, after the adhesion processor 706 chooses all dot-on positions, the adhesion processor 706 chooses a dot-off position. When the ratio of the number of dots to which adhesive toner adheres to the number of dots constituting one pixel exceeds a predetermined adhesion area ratio R, the adhesion processor 706 finishes adhesion of adhesive toner.

As to a color with high saturation belonging to an area A depicted in FIG. 19A corresponding to $C2 \leqq C < CH$ in FIG. 19B, dots are generated as illustrated in FIG. 18C. That is, the number of dot-on positions is greater than the number of dot-off positions. Since Pc=0 as illustrated in FIG. 19B, the adhesion processor 706 chooses a dot-off position to adhere adhesive toner. When the adhesion processor 706 chooses all dot-off positions, the adhesion processor 706 chooses a dot-on position. When a ratio of the number of dots on which adhesive toner adheres to the number of dots constituting one pixel exceeds the predetermined adhesion area ratio R, the adhesion processor 706 finishes adhesion of adhesive toner.

As to a color with medium saturation belonging to an area between the area A and the area B depicted in FIG. 19A corresponding to $C1 \leqq C < C2$ in FIG. 19B, dots are generated as illustrated in FIG. 18B. That is, the number of dot-on positions is substantially equal to the number of dot-off positions.

A dot occupancy D, which represents a ratio at which a color dot is attached to each pixel, is defined.

For example, the dot occupancy D of FIG. 18B is 9/16. As illustrated in FIG. 19B, $Pc=\alpha$ according to the above-described function defined by saturation as an input value.

Therefore, adhesion of adhesive toner is determined according to a ratio of the number of dot-on positions to the number of dot-off positions, which is represented as $\alpha:(1-\alpha)$ where $0 \leqq \alpha \leqq 1$.

It is to be noted that C1, C2, and a are determined according to half tone processing characteristics of the image forming apparatus 5 depicted in FIG. 5.

For example, a case in which the number of dots N per pixel is 16, an adhesion area ratio R is 0.5, and $\alpha=0.3$ is described. Thus, the number of dots to which adhesive toner adheres is calculated as $N\times R=16\times 0.5=8$. The number of dot-on positions to which adhesive toner adheres is represented as $N\times R\times \alpha=16\times 0.5\times 0.3=2.4$, which rounds off to 2. By subtracting 2 from 8, the number of dot-off positions to which adhesive toner adheres for each pixel is 6. Therefore, the number of dots to which adhesive toner adheres for one pixel is 8. Thus, the adhesion processor 706 chooses 2 dot-on positions and 6 dot-off positions. When the dot occupancy D is 9/16, the number of dot-on positions is 9, and the number of dot-off positions is calculated by subtracting 9 from 16. Therefore, the adhesion processor 706 chooses 2 dot positions out of 9 dot positions and 6 dot positions out of 7 dot positions as a dot position to which adhesive toner adheres. Alternatively, when the dot occupancy D is 11/16, since the number of dot-off positions is merely 5, 3 dot-on positions are chosen as dot positions to which adhesive toner adheres. Accordingly, the adhesion processor 706 chooses dot positions to which adhesive toner adheres, such that the ratio of the dot-on position to the dot-off position is close to $\alpha:(1-\alpha)$ as possible.

When a reproduced color of one pixel belongs to the shadow area, the adhesion processor 706 chooses a dot position to which black toner is attached as a dot position to which adhesive toner adheres, and sequentially chooses a dot position in which three colors of toner are superimposed. In this order, adhesive toner adheres to a dot position until the adhesion area ratio reaches the predetermined value.

Figure 20:
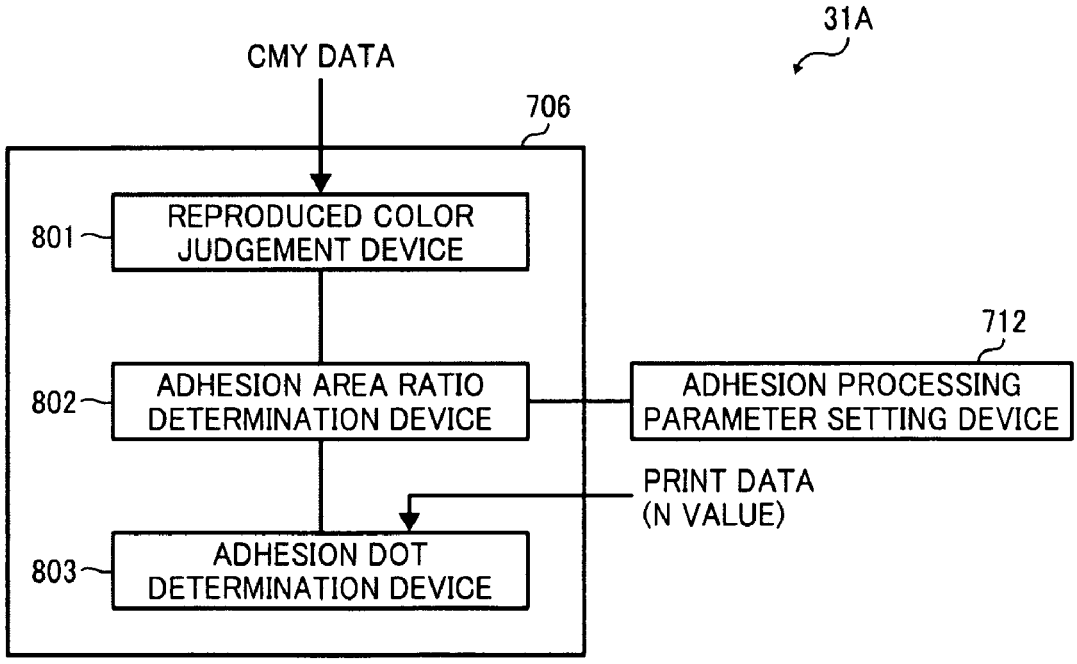
FIG. 20 is a block diagram of an adhesion processor included in the color conversion processor shown in FIG. 17.

FIG. 20 is a block diagram of a structure of the adhesion processor 706. The adhesion processor 706 includes a reproduced color judgment device 801, an adhesion area ratio determination device 802, and an adhesion dot determination device 803.

The reproduced color judgment device 801 calculates a reproduced color from CMY data input for each pixel. The adhesion area ratio determination device 802 determines an adhesion area ratio from the reproduced color. Upon receipt of N value data from the half tone processor 705 depicted in FIG. 17, the adhesion dot determination device 803 determines a dot position to which adhesive toner adheres and transfers data on the dot position as adhesion data to the image forming apparatus 5 depicted in FIG. 1.

Figure 21:
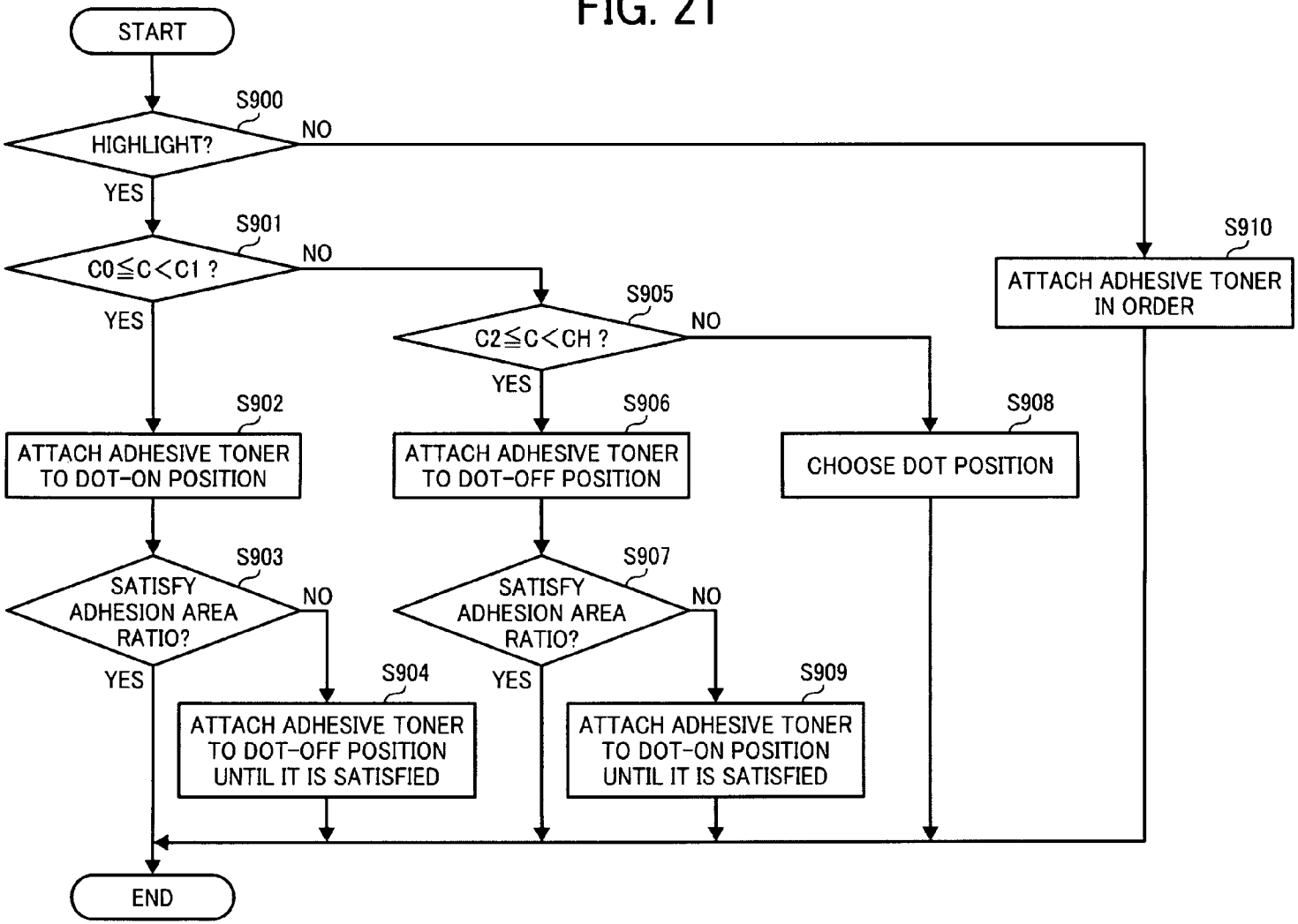
FIG. 21 is a flowchart of adhesion processing performed by an adhesion dot determination device included in the adhesion processor shown in FIG. 20.

FIG. 21 is a flowchart of the adhesion processing performed by the adhesion dot determination device 803 depicted in FIG. 20. When a reproduced color of input data belongs to the highlight area (YES at step S900), and when saturation is low (YES at step S901), adhesive toner is attached to a dot-on position in step S902. When an adhesion area ratio does not satisfy a predetermined value (YES at step S903), adhesive toner is attached to a dot-off position until the adhesion area ratio satisfies the predetermined value in step S904.

Even when a reproduced color of input data belongs to the highlight area (YES at step S900), when saturation is high (YES at step S905), adhesive toner is attached to a dot-off position in step S906. When an adhesion area ratio does not satisfy a predetermined value (NO at step S907), adhesive toner is attached to a dot-on position until the adhesion area ratio satisfies the predetermined value in step S909.

Alternatively, when saturation is medium (NO at step S905), the adhesion dot determination device 803 chooses a dot position to which adhesive toner adheres according to the ratio a depicted in FIG. 19B determined based on input saturation in step S908. When the reproduced color belongs to the shadow area (NO at step S900), adhesive toner adheres to a dot position to which black toner adheres and subsequently adheres to a dot position to which three colors of toner adheres until an adhesion area ratio satisfies a predetermined value in step S910.

Figure 22:
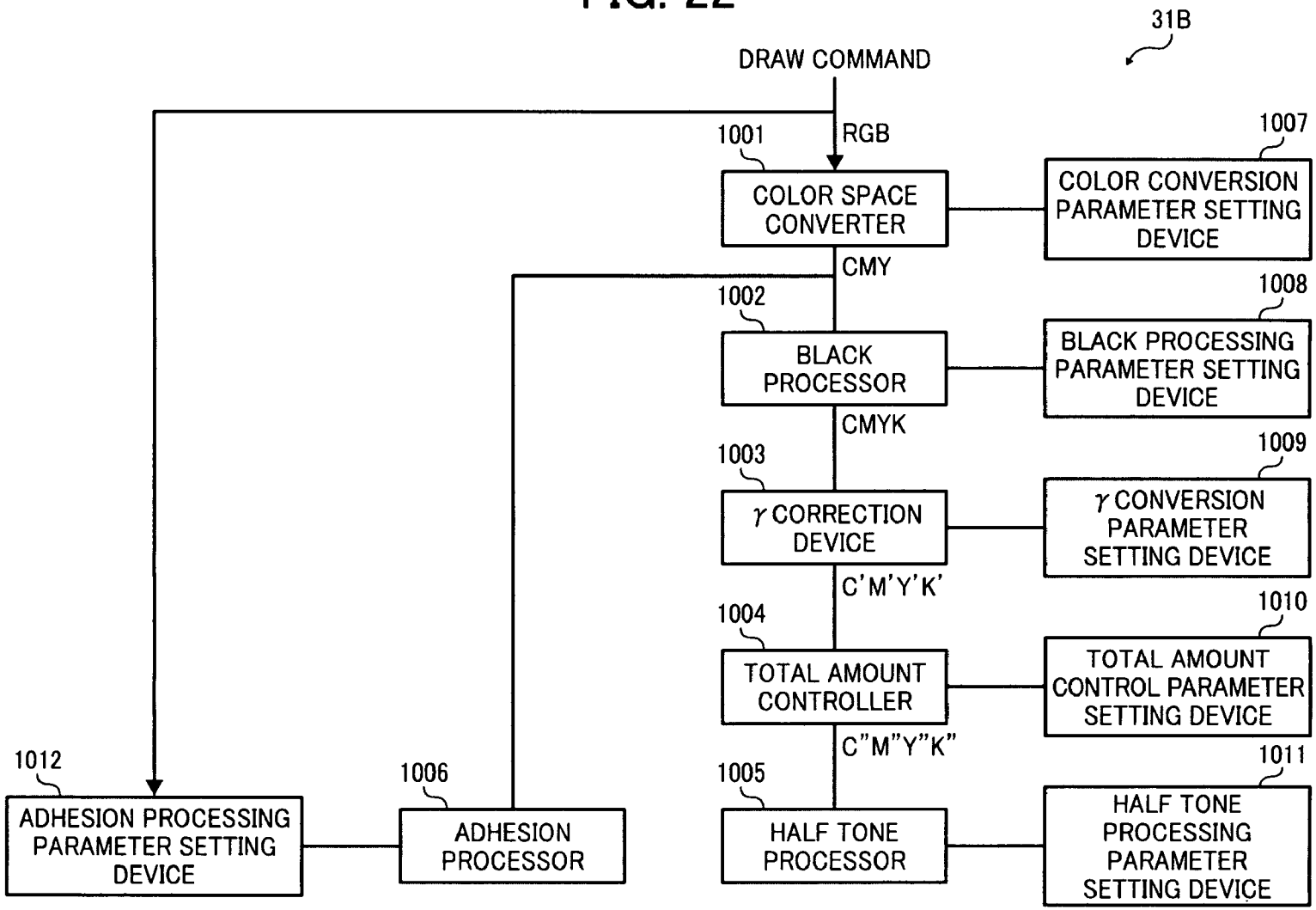
FIG. 22 is a block diagram of a color conversion processor according to yet another illustrative embodiment of the present disclosure.

Referring to FIGS. 22, 23, and 24, a description is now given of changing an adhesion parameter (adhesion area ratio) according to a color distribution of input image data according to yet another illustrative embodiment.

FIG. 22 is a block diagram of a color conversion processor 31B according to this illustrative embodiment. The color conversion processor 31B includes a color conversion parameter setting device 1007, a black processing parameter setting device 1008, a γ conversion parameter setting device 1009, a total amount control parameter setting device 1010, a half tone processing parameter setting device 1011, an adhesion processing parameter setting device 1012, a color space converter 1001, a black processor 1002, a γ correction device 1003, a total amount controller 1004, a half tone processor 1005, and an adhesion processor 1006.

For example, when the input image data uses many colors with high saturation, that is, when the input image data uses the fixed adhesion parameter as illustrated in FIGS. 16A and 16B, the input image may decrease in strength of contact between a light-transmitting medium and a light-reflecting medium, thereby degrading image quality. Therefore, according to this illustrative embodiment, the adhesion processing parameter setting device 1012 rewrites the adhesion parameter according to a color distribution of input image data.

Figure 23A:
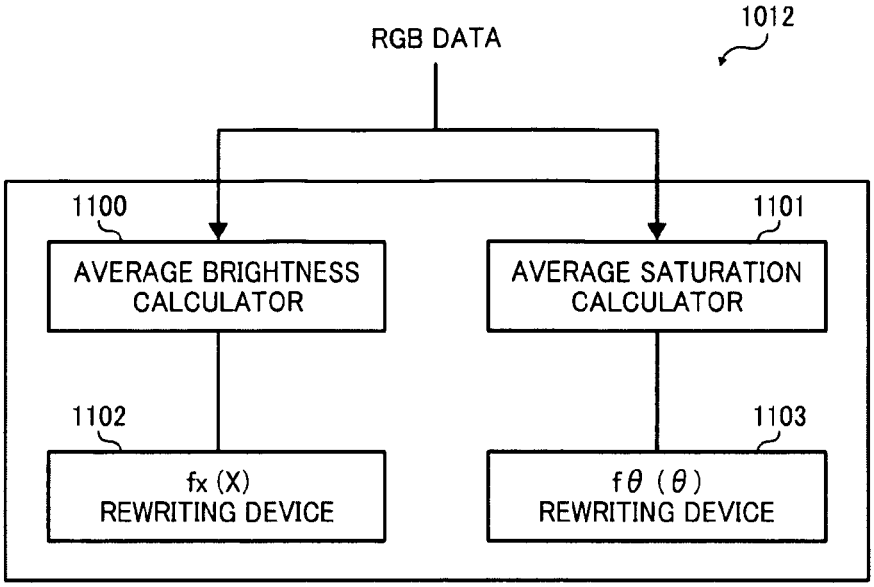
FIG. 23A is a block diagram of an adhesion processing parameter setting device included in the color conversion processor shown in FIG. 22.

FIG. 23A illustrates a structure of the adhesion processing parameter setting device 1012. The adhesion processing parameter setting device 1012 includes an average brightness calculator 1100, an average saturation calculator 1101, an fx (X) rewriting device 1102, and an fθ (θ) rewriting device 1103.

Upon receipt of RGB data, the average brightness calculator 1100 obtains an average value of brightness of all the colors used in the input image data, for example, by dividing (R+G+B) by 3. The average saturation calculator 1101 calculates an average value of saturation of all the colors used in the input image data by dividing (|G−R|+|G−B|) by 2. It is to be noted that these averages are calculated using the number of pixels used in the image data.

By using the average brightness calculated by the average brightness calculator 1100, the fx (X) rewriting device 1102 and the fθ (θ) rewriting device 1103 rewrite the functions fx (X) and fθ (θ) of the adhesion parameters, respectively.

Figure 23B:
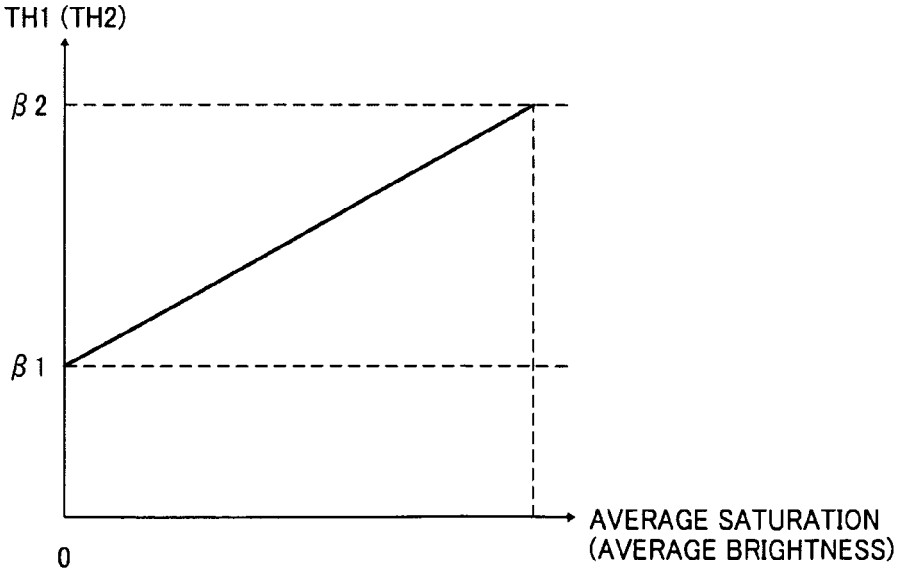
FIG. 23B is a graph of a relation between an adhesion area ratio and average saturation (average brightness).

FIG. 23B is a graph illustrating a relation between an adhesion area ratio and average saturation (average brightness). The adhesion area ratio TH1 (or TH2) is plotted on the vertical axis, and the average brightness (or average saturation) is plotted on the horizontal axis. For example, the fx (X) rewriting device 1102 and the fθ (θ) rewriting device 1103 rewrite the adhesion area ratio TH1 (or TH2) depicted in FIGS. 16A and 16B relative to the average brightness (or average saturation).

As the average brightness (saturation) increases, by increasing the adhesion area ratio TH1 (TH2), optimal correction of the adhesion area ratio for any input image is possible. The adhesion processor 1006 depicted in FIG. 22, serving as an adhesion processing device, performs adhesion processing using the adhesion parameters rewritten by the adhesion processing parameter setting device 1012. It is to be noted that the adhesion processing is similar to that described above according to the above-described embodiments.

Since whether contact or noncontact between a light-transmitting medium and a light-reflecting medium affects the reproduced color, presence or absence of adhesive toner affects the reproduced color. The color space converter 301 depicted in FIG. 4, serving as a color conversion device, sets a color conversion parameter after whether or not adhesion of adhesive toner is determined.

The refractive index of a material used for the adhesive toner needs to be equal to or smaller than refractive index of the color toner, since the reproduced color changes depending on whether contact or noncontact between a light-transmitting medium and a light-reflecting medium due to change of a traveling direction of light reflected by a paper.

It is to be noted that the color toner used in the image forming units 9Y, 9M, 9C, and 9K depicted in FIG. 3A of the image forming apparatus 5 includes the following components: polyester resin having about 100 parts by weight (refractive index of about 1.63), paraffin wax having about 6 parts by weight (refractive index of about 1.40), and silica having about 1.5 parts by weight (refractive index of about 1.46).

In addition to the above components, the color toner includes pigment for determining a color of toner having about 3 to about 6 parts by weight. Although a refractive index varies among pigments, when a refractive index of the pigment differs greatly from a refractive index of binder resin, light scatters between the pigment and the binder, thereby decreasing transparency of toner and narrowing the range of color reproduction. Therefore, the refractive index of the pigment used for the color toner is equivalent to the refractive index of the resin.

The adhesive toner used in the image forming unit 9S depicted in FIG. 3A includes polyester resin having about 100 parts by weight (refractive index of about 1.63), paraffin wax having about 12 parts by weight (refractive index of about 1.40), and silica having about 5 parts by weight (refractive index of about 1.46).

Although the number of parts by weight of the polyester resin having the highest refractive index does not differs from that of the polyester resin used for the color toner, the numbers of parts by weight of the paraffin wax and the silica are greater than those used for the color toner. However, since both the paraffin wax and the silica have the refractive indexes close to the refractive index of the polyester resin and the numbers of parts by weight smaller than that of the polyester resin, the refractive index of the adhesive toner is little affected. As with the pigment, the adhesive toner does not use a material having a refractive index greatly differing from that of the polyester resin as a principal material, since when such a material is mixed in the above components, light scatters among the components, thereby losing transparency of the adhesive toner. Thus, the refractive index of the adhesive toner is equal to that of the color toner.

According to the above-described illustrative embodiments, in the image forming apparatus 5 depicted in FIG. 1, after an image forming device, that is, the image forming units 9Y, 9M, 9C, and 9K depicted in FIG. 3A, forms an image on a light-transmitting medium, an adhesion processing device, for example, the adhesion processor 306 depicted in FIG. 4, chooses an adhesion area to which adhesive toner adheres based on color information, and an adhesion device, that is, the image forming unit 9S depicted in FIG. 3A, attaches adhesive toner to the adhesion area to which adhesive toner adheres. Then, a fixing device, that is, the first fixing device 60, the alignment device 70, and the second fixing device 80 depicted in FIG. 3A, fix the light-transmitting medium to a light-reflecting medium. As a result, the image forming apparatus 5 can form a high-quality image with high saturation. It is to be noted that although the number of colors of toner used for image formation in the above-described embodiments is four, the number of colors of toner used for image formation is not limited to four. Moreover, although the image forming apparatus 5 forms an image using electrophotography according to the above-described non-limiting illustrative embodiments, alternatively the image forming apparatus 5 may be an inkjet printer or the like capable of printing on a light-transmitting medium.

Numerous additional modifications and variations are possible in light of the above teachings. It is therefore to be understood that, within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2008-129831 filed on May 16, 2008 in the Japan Patent Office, the entire contents of which are hereby incorporated herein by reference.

What is claimed is:

1. An image forming apparatus, comprising:

an image forming device to form an image on a light-transmitting medium with image formation toner;

an adhesion processing device to set whether or not to make the light-transmitting medium contact a light-reflecting medium for each area of a plurality of areas that constitute the image;

an adhesion device to adhere adhesive toner to an adhesion area of the light-transmitting medium; and a fixing device to align the light-reflecting medium with the light-transmitting medium such that the light-reflecting medium contacts a surface of the light-transmitting medium to which the adhesive toner adheres and to fix the light-reflecting medium to the light-transmitting medium, wherein the adhesion processing device sets an area of the image in the vicinity of a most saturated point as an area in which the light-transmitting medium does not contact the light-reflecting medium.

2. The image forming apparatus according to claim 1, wherein the adhesion processing device sets an area of the image in the vicinity of a white point as area in which the light-transmitting medium does not contact the light-reflecting medium.

3. The image forming apparatus according to claim 1, wherein the adhesion processing device sets an area of the image in the vicinity of a black point as an area in which the light-transmitting medium contacts the light-reflecting medium.

4. The image forming apparatus according to claim 1, wherein the adhesion processing device sets a ratio of adhesion area to which the adhesive toner adheres based on color information on each area of the image, such that continuity of the adhesion area ratio is maintained between a black point of the image and a most saturated point of the image and between the most saturated point and a white point of the image.

5. The image forming apparatus according to claim 4, wherein the adhesion processing device sets the adhesion area ratio based on an adhesion area ratio defined relative to a degree of lightness of the image and an adhesion area ratio defined relative to saturation of the image.

6. The image forming apparatus according to claim 4, wherein the adhesion processing device changes the adhesion area ratio according to a color distribution of the image.

7. The image forming apparatus according to claim 1, wherein the adhesion processing device sets a dot position of each area of the plurality of areas that constitute the image to which the adhesive toner adheres based on color information.

8. The image forming apparatus according to claim 7, wherein when a color of the image is in the vicinity of a most saturated point of the image the adhesion processing device sets to adhere the adhesive toner to a dot position to which no image formation toner adheres.

9. The image forming apparatus according to claim 7, wherein when a color of the image is in the vicinity of a white point the adhesion processing device sets to adhere the adhesive toner to a dot position to which image formation toner adheres.

10. The image forming apparatus according to claim 7, wherein the adhesion processing device sets to adhere the adhesive toner to a dot position to which three or more colors of image formation toner adhere.

11. The image forming apparatus according to claim 7, wherein the adhesion processing device sets to the adhesive toner to adhere to a dot position to which a black image formation toner adheres.

12. The image forming apparatus according to claim 1, wherein a refractive index of the adhesive toner after fixation is equal to or smaller than that of the image formation toner.

13. The image forming apparatus according to claim 1, further comprising:

a color conversion device to set a color conversion parameter after whether or not the adhesive toner adheres to the area of the light-transmitting medium is determined and to perform color conversion based on the color conversion parameter.

14. An image forming method, comprising:

forming an image on a light-transmitting medium with image formation toner;

setting whether or not to make the light-transmitting medium contact a light-reflecting medium at each area of a plurality of areas that constitute the image;

adhering adhesive toner to an area of the light-transmitting medium;

aligning the light-reflecting medium with the light-transmitting medium such that the light-reflecting medium contacts a surface of the light-transmitting medium to which the adhesive toner adheres;

fixing the light-reflecting medium to the light-transmitting medium;and setting an area of the image in the vicinity of a most saturated point as an area in which the light-transmitting medium does not contact the light-reflecting medium.

15. A printing medium manufactured by an image forming method, the method comprising:

forming an image on a light-transmitting medium with image formation toner;

setting whether or not to make the light-transmitting medium contact a light-reflecting medium for each area of a plurality of areas that constitute the image;

adhering adhesive toner to an area of the light-transmitting medium;

aligning the light-reflecting medium with the light-transmitting medium such that the light-reflecting medium contacts a surface of the light-transmitting medium to which the adhesive toner adheres;

fixing the light-reflecting medium to the light-transmitting medium; and setting an area of the image in the vicinity of a most saturated point as an area to which the light-transmitting medium does not contact the light-reflecting medium.

16. The printing medium according to claim 15, wherein the printing medium includes an image area other than the area in which the light-transmitting medium contacts the light-reflecting medium.

17. The printing medium according to claim 16, wherein the image area is an area n the vicinity of a most saturated point of the image.

18. The printing medium according to claim 16, wherein the image area is an area in the vicinity of a white point of the image.

* * * * *